US007078138B2

(12) United States Patent
Asano et al.

(10) Patent No.: US 7,078,138 B2
(45) Date of Patent: Jul. 18, 2006

(54) APPARATUS AND METHOD FOR FORMING IMAGE FORMING

(75) Inventors: Masao Asano, Hachioji (JP); Akihiko Itami, Hachioji (JP); Hiroshi Yamazaki, Hachioji (JP); Hiroyuki Yamada, Hachioji (JP)

(73) Assignee: Konica Corporation, Tokyo (JP)

( * ) Notice: Subject to any disclaimer, the term of this patent is extended or adjusted under 35 U.S.C. 154(b) by 0 days.

(21) Appl. No.: 10/247,838

(22) Filed: Sep. 19, 2002

(65) Prior Publication Data

US 2003/0147670 A1 Aug. 7, 2003

Related U.S. Application Data

(62) Division of application No. 09/765,029, filed on Jan. 18, 2001, now abandoned.

(30) Foreign Application Priority Data

Jan. 21, 2000 (JP) ..... 2000-012886
Jan. 24, 2000 (JP) ..... 2000-014429

(51) Int. Cl.
*G03G 15/01* (2006.01)

(52) U.S. Cl. ..... 430/45; 430/126; 430/46; 430/125; 430/111.4; 399/223; 399/227; 399/302

(58) Field of Classification Search ..... 430/45, 430/46, 66, 126, 111.4, 125; 399/223, 227, 399/302

See application file for complete search history.

(56) References Cited

U.S. PATENT DOCUMENTS 5,845,185 A * 12/1998 Sakagami et al. ..... 399/302
6,143,452 A * 11/2000 Sakimura et al. ..... 430/58.2
6,265,122 B1 * 7/2001 Itami et al. ..... 430/58.2
6,296,980 B1 * 10/2001 Oshiba et al. ..... 430/110.3

FOREIGN PATENT DOCUMENTS

JP 09218536 A * 8/1997
JP 11143107 A * 5/1999
JP 2000214629 A * 8/2000

OTHER PUBLICATIONS

Diamond, Arthur S. (editor) Handbook of Imaging Materials. New York: Marcel-Dekker, Inc. (1991) p. 178.*

* cited by examiner

*Primary Examiner*—Christopher Rodee
(74) *Attorney, Agent, or Firm*—Lucas & Mercanti, LLP

(57) ABSTRACT

An electrostatic image forming apparatus is disclosed. The image forming apparatus contains a toner used in the developing means having saturated moisture content at a temperature of 30° C. and a relative humidity of 80% of within the range of from 0.1 to 2.0% by weight, and the photoreceptor contains a siloxane resin having an electric charge transfer ability and a crosslinked structure in the surface layer.

21 Claims, 7 Drawing Sheets

APPARATUS AND METHOD FOR FORMING IMAGE FORMING

CROSS REFERENCE TO RELATED APPLICATIONS

This is a Divisional of U.S. patent application Ser. No. 09/765,029, filed Jan. 18, 2001, now abandoned.

FIELD OF THE INVENTION

This invention relates to an image forming apparatus and an image forming method to be used as a copying machine or a printer, particularly relates to those to be used as a color copying machine or a color printer.

BACKGROUND OF THE INVENTION

Recently, a color image has been required in the field of color copying machine and color printer. The color image forming methods having a high practical value are classified according to frequently used terms into 4 kinds, a transfer drum method, intermediate transfer method, KNC method by which plural color images are overlapped on a photoreceptor to form an color image and transferred all at once, and a tandem method.

Such methods are each named based on the different viewpoints from each other. Accordingly, a method, for example, such as an intermediate transfer-tandem method can be existed. Among these methods, a color image forming apparatus according to the intermediate transfer method has been known as one by which a high quality full color image can be obtained. In this method, color images are overlapped on an intermediate transferring member by one photoreceptor used for colors of yellow, magenta, cyan, and black or photoreceptors severally used for each color image, and transferred onto a image receiving material. Among them, a tandem color image forming apparatus in which color images are each formed by a respective color image forming unit and successively transferred, has advantage that various image receiving materials can be used, a high quality color image can be obtained and a full color image can be rapidly obtained. Particularly, the property that the full color image can be obtained at a high speed is a specific advantage.

Besides, regarding the photoreceptor, an organic photoreceptor having an organic photoconductive substance has been widely used. The organic photoreceptor has advantages such as that a material suitable to various exposing light source emitting light within the range of from visible band and infrared band can be easily developed, a material without the pollution of the environment can be selected, and the material can be produced with a low cost. The only one drawback of the organic photoreceptor is that it is weak in the mechanical strength and the frictional abrading and scratches tends to be occurred on the surface thereof when a lot of copies or prints are made.

It is proved that an image defect such as divergence of the registration is occurred in the color images overlapped on the intermediate transfer member since the frictional coefficient between the surface of the intermediate transfer member that of the photoreceptor is varied under a condition with a high temperature and a high humidity, when such the photoreceptor is applied for an image forming apparatus using the intermediate method. It is studied that the use of a photoreceptor or a protective layer each containing a durable organic silicone resin binder as a countermeasure against such the problem. The advantage of such the binder is that the initial layer thickness is kept after the use of a long period since the frictional abrading of the photoreceptor is very low. However, problems of blur and flowing of image caused by filming of toner or paper powder tends to be occurred. Such problems tend to be amplified in the image forming apparatus using the intermediate transfer member.

In the tandem system, four image forming units of yellow, magenta, cyan, and black are usually necessary. In such the system, the photoreceptor used in the image forming unit is abraded by a member contacted or almost contacted with the photoreceptor such as a cleaning blade, a transfer belt, a developer, and a releasing means, and the degree of the abrasion of each of the photoreceptors is not uniform. One reason of such the phenomenon is that the influence of the toners to the photoreceptor are different form each other. When the photoreceptor is repeatedly used, the charging properties of each of the toners are considerably different depending on the difference of the abrasion accompanied with the increasing the repeated times. Such the fact undesirably influences to the color balance of the finished color image. Besides, when a toner having a high moisture content is used, the toner tends to be remained on the abraded surface of the photoreceptor. Accordingly, a part of the toner is repeatedly passed the cleaning process and a film of the toner is formed on the all surface of the photoreceptor by the effect of the pressure of the cleaning means such as a cleaning blade. The formation of the toner filming causes the blur or flow of image. When the degree of such the image blur is different from each other drums, the color balance of the image is broken and the image resolution ability is lowered. As a results of that, such the apparatus cannot be accepted as the commercial product. The toner filming can be prevented by the use of a photoreceptor having an easily abrasive surface so that the surface of the photoreceptor is abraded in some degree by the cleaning means such as a cleaning blade. However, such the countermeasure increases the difference of the abrasion levels of each of the photoreceptors used in each of the image forming unit and results degradation of the color balance.

SUMMARY OF THE INVENTION

The object of the invention is to provide a suitable electrophotographic image by using an image forming apparatus having an intermediate transfer member, particularly to provide an image forming apparatus and an image forming method by which an image defect such as the divergence in the registration of the color images overlapped on the intermediate transfer member, and the blur and flowing of the image are not occurred under a condition with a high temperature and a high humidity.

The another object of the invention is to provide a tandem type color image forming apparatus by which the foregoing problems can be solved, and to provide a color image forming apparatus and an image forming unit to be used in the color image forming apparatus by which an color image having a high resolution and no blur, and an image having a uniform quality and not lowered in the color balance when the apparatus is repeatedly used a lot of times.

The object of the invention can be attained by the followings.

1. An image forming apparatus comprising a photoreceptor comprising a photosensitive layer and a surface layer, a charging means for supplying a charge onto the surface of the photoreceptor, an exposing means for irradiating light to the photoreceptor to form a static latent image on the surface of the photoreceptor, a developing means for forming a colored toner image corresponding to the static latent image on the surface of the photoreceptor, a transferring means for transferring the toner image to an image receiving material, and a cleaning means for removing the toner remained on the photoreceptor surface, wherein the toner used in the developing means has saturated moisture content within the range of from 0.1 to 2.0% by weight at a temperature of 30° C. and a relative humidity of 80%, and the surface layer contains a siloxane resin having an electric charge transfer ability and a crosslinked structure.

2. The image forming apparatus of item 1, wherein the developing means comprises a plurality of developing units containing color toners having different color from each other.
3. The image forming apparatus of item 1, wherein the image forming apparatus comprises an intermediate transfer member to which the developed image on the photoreceptor is transferred, and the toner image transferred on the intermediate transfer member is transferred onto an image receiving material.
4. The image forming apparatus of item 2, wherein the plurality of developing units are provided around the electrophotographic photoreceptor, each of the plurality of developing units is successively operated whereby each of monocolor toner images is formed on the photoreceptor which is transferred to the intermediate transfer member successively to form a color image overlapped on the intermediate transfer member, and the color image overlapped on the intermediate transfer member is transferred all at once onto the image receiving material.
5. The image forming apparatus of item 2, wherein the image forming apparatus comprises a plurality of photoreceptor and a plurality of developing means each containing a color toner having different color from each other, each of the plurality of developing means is composed of a plurality of image forming units corresponding to the plurality of the photoreceptors, and the plurality of developing means is provided around the intermediate transfer member so that the each of images formed by the plurality of the plurality of image forming units is transferred to the intermediate transfer member to form a color image overlapped on the intermediate transfer member.

6. The image forming apparatus of item 1, wherein the siloxane resin contains structure represented by the following Formula 1, and has crosslinking structure, Formula 1

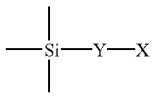

wherein the formula X is a structural unit having charge transportability, Y is a bonding group of two or more valents, and Si is silicon atom.

7. The image forming apparatus of item 6, wherein Y is an atom or group of two or more valents and X is a charge transferable structural unit containing a carbon atom which bonds to Y through the carbon atom.
8. The image forming apparatus of item 7, wherein Y is a substituted or unsubstituted alkylene or arylene group.
9. The image forming apparatus of item 7, wherein Y is an oxygen atom, sulfur atom or —NR group wherein R is hydrogen atom or a monovalent organic group.
10. The image forming apparatus of item 1, wherein the siloxane resin having a crosslinking structure obtained by reacting an organic silicon compound containing hydroxy group or hydrolysable group with a compound having chargetransferable structure unit containing hydroxy group.
11. The image forming apparatus of item 1, wherein the siloxane resin is composed by crosslinking an organic silicon compound and a compound having a charge transferable structure unit containing two or more reactive functional group.
12. The image forming apparatus of item 1, wherein the surface layer of the photoreceptor contains an anti-oxidant.
13. The image forming apparatus of item 10, wherein the anti-oxidant includes hindered phenol or hindered amine compound.
14. The image forming apparatus of item 1, wherein the surface layer of the photoreceptor contains organic or inorganic fine particles.
15. The image forming apparatus of item 1, wherein the surface layer of the photoreceptor contains colloidal silica.
16. The image forming apparatus of item 1, wherein the toner exhibits sum (M) of the relative frequency (m1) of toner particles included in the highest frequency class, and the relative frequency ($m^2$) of toner particles included in the second highest frequency class is number based histogram is at least 70 percent in which natural logarithm ln D is taken as the abscissa and said abscissa is divided into a plurality of classes at an interval of 0.23,which exhibits, D being diameter of toner particles in μm.
17. The image forming apparatus of item 1, wherein the image forming apparatus comprises a plurality of photoreceptor and a plurality of developing means each containing a color toner having different color from each other, each of the plurality of developing means is composed of a plurality of image forming units corresponding to the plurality of the photoreceptors, and each of images formed by the plurality of the plurality of image forming units is successively transferred to the transfer member to form an image 18. The image forming apparatus of item 1, wherein the toner has a volume average diameter of 4 to 9 μm, and toner particles having diameter of 3.0 μm is not more than 30% by number.
19. An image forming unit employed for an image forming apparatus of item 1, wherein the image forming unit comprises a photoreceptor having a resin layer containing a siloxane resin, which photoreceptor is combined with at least one of the charging means, the developing means, the transferring means or the cleaning means.

The other embodiment of the invention is described.

An image forming apparatus, in which a toner image formed on an electrophotographic photoreceptor by a developing means provided around the electrophotographic photoreceptor is transferred onto an intermediate transfer member, and the toner image transferred on the intermediate transfer member is transferred onto a image receiving material, then the toner remained on the electrophotographic photoreceptor surface is removed by a cleaning means, wherein the saturated moisture content of the toner used in the developing means is from 0.1 to 2.0% by weight at a temperature of 30° C. and a relative humidity of 80%, and the surface layer of the photoreceptor contains a siloxane resin.

An image forming apparatus, in which a color toner image is formed on an intermediate transfer member by transferring monocolor images one by one each formed on an electrophotographic photoreceptor by plural developing means each containing color toners different in the color from each other, which are provided around the electrophotographic photoreceptor and successively operated, and the color image overlapped on the intermediate transfer member is transferred all at once onto an image receiving material, then the toner remained on the electrophotographic photoreceptor surface is removed by a cleaning means, wherein the saturated moisture content of the toner used in the developing means is from 0.1 to 2.0% by weight at a temperature of 30° C. and a relative humidity of 80%, and the surface layer of the electrophotographic photoreceptor contains a siloxane resin.

An image forming apparatus having a plurality of image forming units each for forming toner image on an electrophotographic photoreceptor by developing means arranged around the electrophotographic photoreceptor, and an intermediate transfer member, the plural image forming units are arranged around them, carrying the overlapped toner images formed on the electrophotographic photoreceptor, in which the toner image carried on the intermediate transfer member is transferred onto an image receiving material then the toner remained on the electrophotographic photoreceptor, wherein the saturated moisture content of the toner used in the developing means is from 0.1 to 2.0% by weight at a temperature of 30° C. and a relative humidity of 80%, and the surface layer of the electrophotographic photoreceptor contains a siloxane resin.

The foregoing image forming apparatus wherein the siloxane resin is a siloxane resin having an electric charge transfer ability and a crosslinked structure.

An image forming apparatus in which a toner image formed on an electrophotographic photoreceptor by a developing means arranged around the electrophotographic photoreceptor is once transferred onto an intermediate transfer member, and the toner image transferred on the intermediate transfer member is transferred onto an image receiving material, and then the toner remained on the surface of the electrophotographic photoreceptor is removed by a cleaning means, wherein the saturated moisture content of the toner used in the developing means is from 0.1 to 2.0% by weight at a temperature of 30° C. and a relative humidity of 80%, and the surface layer of the electrophotographic photoreceptor contains a siloxane resin having crosslinking structure represented by the following Formula 1.

Formula 1

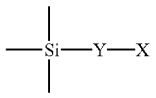

In the formula X is a structural unit having charge transportability, Y is a bonding group of two or more valents, and Si is silicon atom.

An image forming apparatus, in which a color toner image is formed on an intermediate transfer member by transferring monocolor images one by one each formed on an electrophotographic photoreceptor by plural developing units each containing color toners different in the color from each other, which are provided around the electrophotographic photoreceptor and successively operated, and the color image overlapped on the intermediate transfer member is transferred all at once onto an image receiving material, then the toner remained on the electrophotographic photoreceptor surface is removed by a cleaning means, wherein the saturated moisture content of the toner used in the developing means is from 0.1 to 2.0% by weight at a temperature of 30° C. and a relative humidity of 80%, and the surface layer of the electrophotographic photoreceptor contains a siloxane resin having crosslinking structure represented by the Formula 1.

An image forming apparatus having a plurality of image forming units each for forming toner image on an electrophotographic photoreceptor by developing means arranged around the electrophotographic photoreceptor, and an intermediate transfer member, the plural image forming units are arranged around them, carrying the overlapped toner images formed on the electrophotographic photoreceptor, in which the toner image carried on the intermediate transfer member is transferred onto an image receiving material then the toner remained on the electrophotographic photoreceptor is cleaned, wherein the saturated moisture content of the toner used in the developing means is from 0.1 to 2.0% by weight at a temperature of 30° C. and a relative humidity of 80%, and the surface layer of the electrophotographic photoreceptor contains a siloxane resin having crosslinking structure represented by the Formula 1.

In the formula 1, X is preferably a charge transferable structural unit containing a carbon atom which bonds to Y through the carbon atom, and Y is preferably an atom or group of two or more valents bonding to silicon atom and carbon atom composing a part of above mentioned charge transferable structural unit X.

Preferable example of Y is a substituted or unsubstituted alkylene or arylene group.

The other preferable example of Y is —O—, —S— and >NR wherein R is hydrogen atom or monovalent organic group.

An image forming apparatus, in which a toner image formed on an electrophotographic photoreceptor by a developing means provided around the electrophotographic photoreceptor is transferred onto an intermediate transfer member, and the toner image transferred on the intermediate transfer member is transferred onto a image receiving material, then the toner remained on the electrophotographic photoreceptor surface is removed by a cleaning means, wherein the saturated moisture content of the toner used in the developing means is from 0.1 to 2.0% by weight at a temperature of 30° C. and a relative humidity of 80%, and the surface layer of the photoreceptor contains a siloxane resin having a crosslinking structure obtained by reacting an organic silicon compound containing hydroxy group or hydrolysable group with a compound having chargetransferable structure unit containing hydroxy group.

The surface layer of the photoreceptor preferably contains an anti-oxidant.

The preferable example of the anti-oxidant includes hindered phenol or hindered amine compound.

The surface layer of the photoreceptor preferably contains organic or inorganic fine particles.

The surface layer of the photoreceptor preferably contains colloidal silica.

The toner preferably has a volume average diameter of 4 to 9 μm and toner particles having diameter of 3.0 μm is not more than 30% by number.

The diameter of toner particles is designated as D (in (μm). In a number based histogram, in which natural logarithm ln D is taken as the abscissa and said abscissa is divided into a plurality of classes at an interval of 0.23, a toner is preferred, which exhibits at least 70 percent of the sum (M) of the relative frequency (m1) of toner particles included in the highest frequency class, and the relative frequency ($m^2$) of toner particles included in the second highest frequency class.

Further embodiments of the invention are described.

1. A tandem type color image forming apparatus comprising a plurality of image forming units each having a photoreceptor comprising a photosensitive layer and a resin layer, and a charging means for supplying a charge onto the surface of the photoreceptor, an exposing means for irradiating light to the charged area of the photoreceptor and forming a static latent image on the surface of the photoreceptor, a developing means for forming a colored toner image corresponding to the static latent image on the surface of the photoreceptor, a transferring means for transferring the toner image to an image receiving material, and a cleaning means for removing the toner remained on the photoreceptor surface, each arranged around the photoreceptor, and toner images each formed by toners each different from each other in the color thereof and charged in each of the image forming units, respectively, are successively transferred to the image receiving material to form an color image, wherein the saturated moisture content at a temperature of 30° C. and a relative humidity of 80% of each of the toners each used in each of the image forming units is within the range of from 0.1 to 2.0% by weight, and the resin layer of the photoreceptor contains a siloxane resin.

2. A tandem type color image forming apparatus comprising a plurality of image forming units each having a photoreceptor comprising a photosensitive layer and a resin layer, and a changing means for supplying a charge onto the surface of the photoreceptor, an exposing means for irradiating light to the charged area of the photoreceptor and forming a static latent image on the surface of the photoreceptor, a developing means for forming a colored toner image corresponding to the static latent image on the surface of the photoreceptor, a transferring means for transferring the toner image to an image receiving material, and a cleaning means for removing the toner remained on the photoreceptor surface, each arranged around the photoreceptor, and toner images each formed by toners each different from each other in the color thereof and charged in each of the image forming units, respectively, are successively transferred to an intermediate transfer member, then the image formed on the intermediate transfer member is transfer on to the image receiving material to form an color image, wherein the saturated moisture content at a temperature of 30° C. and a relative humidity of 80% of each of the toners each used in each of the image forming units is within the range of from 0.1 to 2.0% by weight, and the resin layer of the photoreceptor contains a siloxane resin.

DETAILED DESCRIPTION OF THE INVENTION

Figure 1:
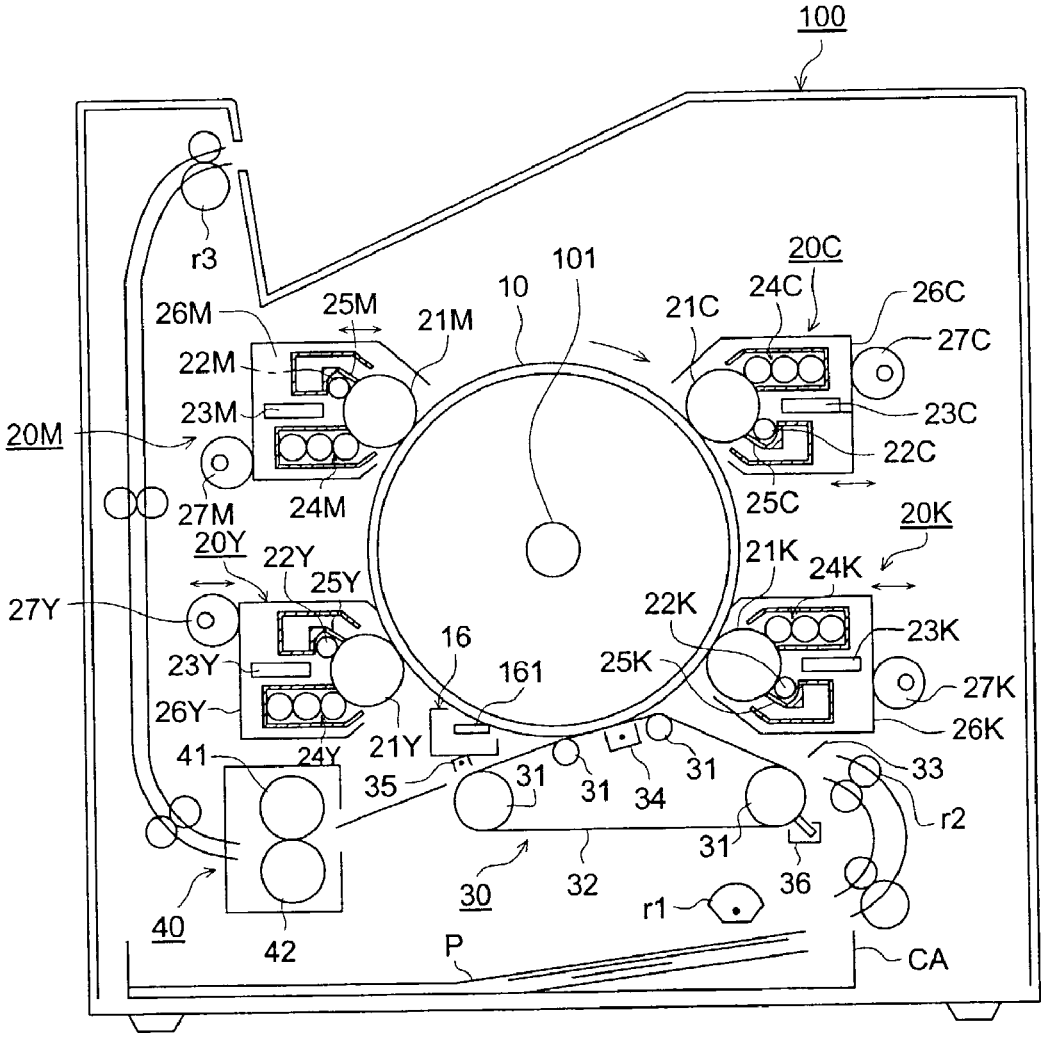
FIG. 1 shows a cross section of a color image forming apparatus according to the invention.

As above-mentioned, four image forming units each corresponding to each of the color of yellow, magenta, cyan, and black are usually used in the tandem type image forming apparatus. The object of the invention can be attained by the use of a photoreceptor having a difficultly abradable resin layer as the photoreceptor to be used in each of the image forming units and toners each having a small moisture content even under a high temperature and high humidity condition as the toners to be charged in each of the image forming units to reduce the difference of the properties between each of the image forming units.

The effect of the invention is realized either in the intermediate transfer tandem system or the tandem system in which the image is directly transferred to the image receiving material.

The toner and the developer to be used in the invention are described below.

<Toner to be Used in the Invention>

The toner to be used in the invention has a saturated moisture content of from 0.1 to 2.0% by weight at a temperature of 30° C. and a relative humidity of 80%. The electrophotographic photoreceptor used in the invention contains a siloxane resin which has a trait that it is difficultly abraded by friction. However, a toner having a hygroscopic property causes filming of the toner on the surface of the photoreceptor and the blur and the defects of the image since the surface of the photoreceptor containing is made relatively hydrophilic by the presence of the siloxane resin.

It is preferably that the toner satisfy the requirement on the fore going saturated moisture content for inhibiting the occurrence of the toner filming and producing the apparatus by a lowered cost.

In the invention the saturate moisture content of the toner is within the range of from 0.1 to 2.0% by weight at a temperature of 30° C. and a relative humidity of 80%. The moisture content can be controlled by the following methods.

In the first method, the content of a hydrophobic component contained in the binder resin is increased. The content styrene having a strong hydrophobic property in the whole monomer is preferably made not less than 50%, more preferably not less than 60%, further preferably not less than 70% by weight 70%, by weight.

It is effective to lower the moisture content of an outer additive of the toner. For such the purpose, it is also effective to raise the hydrophobicity of the outer additive. The outer additive having a hydrophobicity of not less than 60 is preferably used.

It is also effective to raise the amount of a non-polar mold releasing agent existing at the surface of the toner. For such the purpose, the use of a polyolefin wax is particularly suitable. The amount of the polyolefin existed at the surface can be increased by a method in which a mechanical pulverizer is used and the polyolefin is bleed out to the toner surface by frictional heating at the time of the pulverization.

The toner to be used in the invention may be produced by a usually applied pulverization method by which a binder resin, a colorant, and additives to be added according to necessity are kneaded, crushed and classified, or a method in which the toner resin particle containing a mold releasing agent and a colorant is synthesized in a medium.

Listed as methods for fusing fine resin particles in a water-based medium may be those described in, for example, Japanese Patent Publication Open to Public Inspection Nos. 63-186253, 63-282749, 7-146583, and others. Listed as the most preferable fusing method is one in which fine resin particles are subjected to salting-out/fusing in a water-based medium. The weight average particle diameter of fine resin particles, which are employed to obtain the toner of the present invention, is preferably between 50 and 2,000 nm, and particularly preferably 50 to 300 nm. Such fine resin particles may be obtained employing any of the several granulation polymerization methods such as an emulsion polymerization method, a suspension polymerization method, a seed polymerization method, and the like. The preferred are fine resin particles which are obtained employing the emulsion polymerization method.

A monomer to be used for production of the resin is described below. A known polymerizable monomer can be used in both of the methods by the kneading, crushing and classifying and by the synthesizing the toner resin particle in the medium. One or more kinds of the monomer may be used in combination to satisfy required properties. A generally known binder resin such as a styrene resin, an acryl resin, a styrene-acryl resin, a polyester resin, a styrene-butadiene resin, and an epoxy resin maybe used without any limitation.

The monomers for constituting the styrene resin, the acryl resin and the styrene-acryl resin include the followings: a styrene and a styrene derivative such as styrene, o-methylstyrene, m-methylstyrene, p-methylstyrene, α-methylstyrene, p-chlorostyrene, 3,4-dichlorostyrene, p-phenylstyrene, p-ethylstyrene, 2,4-dimethylstyrene, p-t-butylstyrene, p-n-hexylstyrene, p-n-octylstyrene, p-n-nonylstyrene, p-n-decylstyrene, and p-n-dodecyl styrene; a methacrylic ester derivative such as methyl methacrylate, ethyl methacrylate, n-butyl methacrylate, iso-propyl methacrylate, iso-butyl methacrylate, t-butyl methacrylate, n-octyl methacrylate, 2-ethylhexyl methacrylate, stearyl methacrylate, lauryl methacrylate, phenyl methacrylate, diethylaminoethyl methacrylate, and dimethylaminoethyl methacrylate; and an acrylic ester derivative such as methyl acrylate, ethyl acrylate, iso-propyl acrylate, n-butyl acrylate, t-butyl acrylate, iso-butyl acrylate, n-octyl acrylate, 2-ethylhexyl acrylate, stearyl acrylate, lauryl acrylate, phenyl acrylate, dimethylaminoethyl acrylate, and diethylaminoethyl acrylate. These monomers may be used solely or in combination.

Monomers usable in another vinyl polymer include the followings: an olefin such as ethylene, propylene, and isobutylene; a halogenized vinyl compound such as vinyl chloride, vinylidene chloride, vinyl bromide, vinyl fluoride, and vinylidene fluoride; a vinyl ester such as vinyl propionate, vinyl acetate, and vinyl benzoate; a vinyl ether such as vinyl methyl ether, and vinyl ethyl ether; a vinyl ketone such as vinyl methyl ketone, vinyl ethyl ketone, and vinylhexyl ketone; an N-vinyl compound such as N-vinylcarbazole, N-vinylindole, and N-vinylpyrrolidone; a vinyl compound such as vinylnaphthalene, and vinylpyridine; and a derivative of acrylic acid and methacrylic acid such as acrylonitrile, methacrylonitrile, N-butylacrylamide, N,N-dibutylacrylamide, methacrylamide, N-butylmethacrylamide, and N-octadecylacrylamide. These vinyl monomers may be used solely or in combination.

Examples of monomer to obtain a carbonic acid polymer of styrene-acryl resin (vinyl resin) include acrylic acid methacrylic acid, α-ethylacrylic acid, fumaric acid, maleic acid, itaconic acid, cinnamic acid, monobutyl maleate, monooctyl maleate, cinnamic anhydride, and a methyl half ester of alkenylsuccinic acid.

A crosslinking agent such as vinylbenzene, ethylene glycol diacrylate, diethylene glycol diacrylate, triethylene glycol diacrylate, ethylene glycol dimethacrylate, diethylene glycol dimethacrylate, and triethylene glycol dimethacrylate.

The polyester resin is a resin produced by the condensation polymerization of a di- or more-valent carbonic acid component and a di- or more-valent alcohol component. Examples of the di-valent carboxylic acid include maleic acid, fumaric acid, citraconic acid, itaconic acid, gultaconic acid, phthalic acid, isophthalic acid, terephthalic acid, succinic acid, adipic acid, sebacic acid, azelaic acid, malic acid, n-dodecylsuccinic acid, n-dodecylsuccinic acid, isododecylsuccinic acid, n-octylsuccinic acid, and n-octenylsuccinic acid. Anhydride compounds of those are also usable.

Examples of di-valent alcohol constituting the polyester resin include an etherized bisphenol such as polyoxypropylene (2,2)-2,2-bis(4-hydroxyphenyl)propane, polyoxypropylene(3,3)-2,2-bis(4-hydroxyphenyl)propane, polyoxypropylene(2,0)-2,2-bis(4-hydroxyphenyl)propane, polyoxypropylene(2,0)-polyoxyethylene(2,0)-2,2-bis(4-hydroxyphenyl)propane, and polyoxypropylene(6)-2,2-bis(4-hydroxyphenyl)propane; ethylene glycol, diethylene glycol, triethylene glycol, 1,2-propylene glycol, 1,2-propylene glycol, 1,3-propylene glycol, 1,4-butanediol, 1,4-butenediol, neopentyl glycol, 1,5-pentane glycol, 1,6-hexane glycol, 1,4-cyclohexanedimethanol, dipropylene glycol, polyethylene glycol, polypropylene glycol, polyteramethylene glycol, bisphenol A, bisphenol Z, and hydrogenated bisphenol A.

Examples of monomer of a polyester resin having a crosslinked structure include the following tri-valent carboxylic acid such as 1,2,4-benzenetricarboxylic acid, 2,5,7-naphthalene tricarboxylic acid, 1,2,4-naphthalene tricarboxylic acid, 1,2,4-butanetricarboxylic acid, 1,2,5-hexanetricarboxylic acid, 1,3-dicarboxyl-2-methyl-2-methylenecarboxypropane, 1,2,4-cyclohexanetricarboxylic acid, tetra(methylenecarboxyl)methane, 1,2,7,8-octanetetracarboxylic acid, pyromellitic acid, and an empoletrimer acid. The crosslinked polyester resin may also be produced by addition of an anhydride compound of these acids, or a poly-valent alcohol such as sorbitol, 1,2,3,6-hexanetetrol, 1,4-sorbitol, pentaerythritol, dipentaerythritol, tripentaerythritol, 1,2,4-pentanetriol, 1,2,5-pentanetriol, glycerol, 2-methylpropane triol, 2-methyl-1,2,4-butanetriol, trimethylolethane, trimethylolpropane, and 1,3,5-trihydroxymethylbenzene.

Inorganic pigment and organic pigment can be employed for coloring agent.

Arbitrary inorganic pigment can be employed. Practical inorganic pigment is listed below.

Carbon black such as furnace black, channel black, acetylene black, thermal black and lamp black is exemplified as black pigment. Magnetic powders such as magnetite and ferrite are employed for black pigment.

These inorganic pigments can be used individually or two or more in combination optionally selected according to needs. And the content of pigment is usually 2–20 mass %, and preferably, 3–15 mass % of polymer.

The above-mentioned magnetite can be employed to use as magnetic toner. It is preferable to employ 20–60 mass % of magnetite in toner from a point of view to give predetermined magnetic characteristics in this case.

An organic pigment can be also employed. Practical organic pigment is exemplified below.

Magenta or Red Pigment

C.I. Pigment red 2, C.I. Pigment red 3, C.I. Pigment red 5, C.I. Pigment red 6, C.I. Pigment red 7, C.I. Pigment red 15, C.I. Pigment red 16, C.I. Pigment red 48:1, C.I. Pigment red 53:1, C.I. Pigment red 57:1, C.I. Pigment red 122, C.I. Pigment red 123, C.I. Pigment red 139, C.I. Pigment red 144, C.I. Pigment red 149, C.I. Pigment red 166, C.I. Pigment red 177, C.I. Pigment red 178, and C.I. pigment red 222.

Orange or Yellow Pigment

C.I. Pigment orange 31, C.I. Pigment orange 43, C.I. Pigment yellow 12, C.I. Pigment yellow 13, C.I. Pigment yellow 14, C.I. Pigment yellow 15, C.I. Pigment yellow 17, C.I. Pigment yellow 93, C.I. Pigment yellow 94, C.I and Pigment yellow 138.

Green or Cyan Pigment

C.I. Pigment blue 15, C.I. Pigment blue 15:2, C.I. Pigment blue 15:3, C.I. Pigment blue 16, C.I. Pigment blue 60 and C.I. pigment green 7.

These organic pigments can be used individually or two or more jointly selected according to needs. And content of pigment is 2–20 mass % and preferably 3–15 mass % for polymer.

The colorant subjected to surface modification can be employed. The practical surface modifying agent includes silane coupling agent, titanium coupling agent and aluminum coupling agent.

So-called outer additive is added to toner of the present invention for a purpose of improvement of fluidity, charging characteristics and cleaning characteristics. Various kinds of inorganic fine particles, organic fine particles and lubricant can be employed.

Conventional materials may be employed for the inorganic fine particles. Fine particles of silica, titanium alumina etc. are employed preferably in practice. The fine particles are preferably hydrophobic. As fine particles of silica R-805, R-976, R-974, R-972, R-812 and R-809 manufactured by Nihon Aerosil Co., Ltd., HVK-2150 and H-200 manufactured by Hoechst company, TS-720, TS-530, TS-610, H-5 and MS-5 manufactured by Cabot company, are mentioned as practical example.

As titanium fine particle, T-805 and T-604 manufactured by Nihon Aerosil Co., Ltd., MT-100S, MT-100B, MT-500BS, MT-600, MT-600SS and JA-1 manufactured by TAYCA Corporation, TA-300, SI TA-500, TAF-130, TAF-510 and TAF-510T manufactured by Fuji titanium company, IT-S, IT-OA, IT-OB and IT-OC manufactured by Idemitsu Kosan company, are mentioned for example.

As alumina fine particle, RFY-C and C-604 manufactured by Nihon Aerosil Co., Ltd., TTO-55 of manufactured by ISHIHARA SANGYO KAISHA, LTD. are given for example.

Spherical organic fine particles having number average primary particle diameter around 10–2000 nm can be employed. Homopolymer such as styrene or methyl methacrylate and copolymer of these can be used.

As lubricant, for example, stearic acid salt of such as zinc, aluminum, copper, magnesium and calcium, salt of oleic acid of such as zinc, manganese, iron, copper and magnesium, palmitic acid salt of such as zinc, copper, magnesium and calcium, linoleic acid salt of such as zinc and calcium, ricinoleic acid salt of such as zinc and calcium, and metal salt of higher fatty acid are given.

Content of this outer additive is preferably around 0.1 to 5 mass % for toner.

In the toner preparation process the above mentioned additives may beaded to the toner particles obtained by above process, for the purpose of, for example, improving fluidity, charging characteristics and cleaning characteristics.

In order to add said additives various mixers, which are known in the art, such as a tubular mixer, a Henschel mixer, a Nauter mixer, a V-shaped mixer, and the like may be employed.

The toner may contain, in addition to binder resin and colorant, materials giving various function. Practically, releasing agent and charge controlling agent are exemplified.

Specifically, examples of the releasing agent includes conventional one, practically, olefin waxes such as polypropylene and polyethylene, or denaturation thereof, natural waxes such as carnauba wax and rice wax, amide wax such as fatty acid bisamide, and the like. It is preferred that these are added as a releasing agent and are subjected to salting out/fusing together with resin or colorant as mentioned above.

In the same manner, it is possible to use various charge control agents which are known in the art and are capable of being dispersed in water. Specifically listed are nigrosine based dyes, metal salts of naphthenic acid or higher fatty acids, alkoxylated amines, quaternary ammonium salts, azo based metal complexes, salicylic acid metal salts or metal complexes thereof, and the like.

<Developers>

The toner of the present invention may be employed as either a single component developer or a two-component developer. However, it is preferably employed as a two-component developer.

When employed as a single component developer, there is a method in which said toner is employed as a non-magnetic single component developer without any further alteration. Generally, however, magnetic particles having a size of about 0.1 to about 5 μm are incorporated into toner particles and employed as a magnetic single component developer. As the incorporation method, magnetic particles are incorporated into non-spherical particles in the same manner as for colorants.

Further, the toner is blended with a carrier, and can be employed as a two-component developer. In such case, employed as magnetic particles of the carrier are conventional materials, known in the art, such as iron, ferrite, magnetite, and the like, as well as alloys of such metal with other metals such as aluminum, lead, and the like. Of these, ferrite is specifically preferred. Said magnetic particles preferably have a volume average diameter of 15 to 100 μm, and more preferably have one between 25 to 60 μm.

The volume average particle diameter of said carrier is typically measured employing a laser diffraction type particle distribution meter, "HELOS", (manufactured by Sympatec Co.) provided with a wet type homogenizer.

The carrier is preferably one which is obtained by further coating resin onto magnetic particles, or a so-called resin-dispersed type carrier which is obtained by dispersing magnetic particles into resin. Resin compositions for coating are not particularly limited. For example, employed are olefin based resins, styrene based resins, styrene/acryl based resins, silicone based resins, ester based resins, fluorine containing polymer based resins, and the like. Further, resins to compose the resin-dispersed type carrier are also not particularly limited, and any of those known in the art may be employed. For example, employed may be styrene acrylic resins, polyester resins, fluorine based resins, phenol resins, and the like.

In the invention, the electrostatic latent image formed on the image carrying member can be developed either by a one- or two-component developer.

The one-component developer comprises a magnetic toner comprising at least a magnetic powder and a binder resin. The magnetic toner may contain a colorant.

The two-component developer comprises a toner particle (toner) and a carrier particle (carrier). The development is performed by a contact or non-contact method while a polar direct voltage of the same or reverse polarity to that of the toner and an alternating voltage are applied by overlap between a developing sleeve and the photoreceptor as the bias voltage.

The toner particle (toner) to be used in the developer is described below.

When the average diameter of the toner is become coarse, the roughness of image is made conspicuous. Generally, an image of fine parallel lines with a pitch of about 10 lines/mm can be sufficiently developed by a toner of an average diameter of about 20 μm without any problem. However, the resolving power of the image is considerably raised and the high quality clear image in which the difference of density is reproduced with a high fidelity can be obtained when a fine toner having an average diameter of from 2 to 9 μm.

A usual non-magnetic or magnetic toner having a spherical of irregular shape can be used as the foregoing toner. A fluidizing agent for improving the fluidity of the particle and a cleaning aid effective for cleaning the surface of the image carrying member may be mixed with the toner. A colloidal silica, a silicone varnish, a metal soap and a nonionic surfactant may be used as the fluidizing agent, and a metal salt of fatty acid, a silicone substituted an organic group, and a fluorinated surfactant can be used as the cleaning aid.

The electrophotoreceptor employed in the invention is described.

In the invention, the cross-linked siloxane resin having the charge transportable structural unit can be prepared by a known method using an organic silicon compound having hydroxyl group or a hydrolyzable group. Such the organic silicon compound is represented by the following Formula A, B, C or D.

$Si(X)_4$ Formula A $R_1Si(X)_3$ Formula B

Formula C $$\begin{array}{l} R_2Si(X)_2 \\ \quad\;\; | \\ \quad\;\; R_3 \end{array}$$

Formula D $$\begin{array}{l} \quad\;\; R_5 \\ \quad\;\; | \\ R_4SiX \\ \quad\;\; | \\ \quad\;\; R_6 \end{array}$$

In the formulas, $R_1$ through $R_6$ are each an organic group in which a carbon atom thereof is directly boned with the silicon atom in the formula, X is a hydroxyl group or a hyrolyzable group.

When X in the above formulas is a hydrolyzable group, examples thereof include a methoxy group, an ethoxy group, a methylethyl ketoxime group, a diethylamino group, an acetoxy group, a propenoxy group, a propoxy group, a butoxy group and a methoxyethoxy group. Example of the organic group represented by $R_1$ through $R_6$ in each of which a carbon atom is directly bonded to the silicon atom, include an alkyl group such as a methyl group, an ethyl group, a propyl group and a butyl group, an aryl group such as a phenyl group, a tolyl group, a naphthyl group and a biphenyl group, an epoxy-containing group such as a γ-glycidoxypropyl group and a β-(3,4-epoxycyclohexyl)ethyl group, an (metha)acryloyl-containing group such as a γ-acryloxypropyl group and a γ-methacryloxypropyl group, a hydroxyl-containing group such as a γ-hydroxypropyl group and a 2,3-dihydroxypropyloxypropyl group, a vinyl-containing group such as a vinyl group and a propenyl group, a mercapto-containing group such as a γ-mercaptopropyl group, an amino-containing group such as a γ-aminopropyl group and an N-β-(aminoethyl)-γ-aminopropyl group, a halogen-containing group such as a γ-chloropropyl group, an 1,1,1-trifluoropropyl group, a nonafluorohexyl group and perfluorooctylethyl group, and an alkyl group substituted by a nitro group or a cyano group. The organic groups represented by $R_1$ through $R_6$ may be the same as or different from each other.

Generally, the reaction of the organic siloxane compound for making a high molecular weight is inhibited when the number n of the hydrolyzable group is one. When n is 2, 3 or 4, the high molecular weight making reaction tends easily to be progressed, and when n 3 or 4, the cross-linking reaction can be strongly progressed. Accordingly, controlling such the factors can control the storage ability of the coating liquid of the layer and the hardness of the coated layer.

Hydrolysis condensation product, which is prepared by oligomerize or polymerize a compound obtained by hydrolyzing the above mentioned organic silicon compound under acid or alkali condition, may be employed for a raw material of the above mentioned siloxane resin.

The siloxane resin of the invention is a resin which is formed and hardened by a reaction (including a hydrolyzing, and a reaction in the presence of a catalyst or a cross-linking agent) of a monomer, an oligomer or a polymer having a siloxane bond in the chemical structural thereof unit to form a three-dimensional network structure.

In another words, the siloxane resin of the invention means a cross-linked siloxane resin formed as a result of the formation of three-dimensional network structure by acceleration of siloxane bonding formation of the organic compound having a siloxane bond by a hydrolyzing reaction and a dehydrating reaction.

Moreover, the siloxane resin may be a resin containing a silica particle as a part of the cross-linked structure by adding a colloidal silica particle having a hydroxyl group or a hydrolyzable group.

The charge transportable structural unit is a chemical structural unit or a residue of charge transportable compound showing an electron or hole mobility. In the invention the cross-linked siloxane resin having a charge transportable structural unit is a siloxane resin in which a chemical structure showing a drift mobility of electron or a hole (i.e., the structural unit having a charge transporting ability) is built-in. In concrete, the cross-linked siloxane resin having the charge transporting ability according to the invention has a compound usually used as a charge transporting substance (hereinafter referred to a charge transportable compound or CTM) as a partial structure thereof.

The charge transportable structural unit is a structural unit having drift mobility of electron or hole or a residue of charge transportable compound. In other definition, the charge transportable structural unit is a chemical structural unit or a residue of charge transportable compound by which an electric current caused by charge transportation can be detected by a known method for detecting the charge transportation ability such as Time-Of-Flight method.

The charge transportable compound which can form a charge transportable structural unit by a reaction with organic silicon compound in the siloxane resin is described.

Examples of hole transporting type CTM which each are contained in the siloxane resin as the partial structure thereof are as follows: oxazole, oxadiazole, thiazole, triazole, imidazole, imidazolone, imidazoline, bis-imidazolidine, styryl, hydrazone, benzidine, pyrazoline, stilbene compounds, amine, oxazolone, benzothiazole, benzimidazole, quinazoline, benzofuran, acridine, phenazine, aminostilbene, poly-N-vinylcarbazole, poly-1-vinylpyrene and poly-9-vinylanthrathene.

Examples of electron transporting type CTM which each are contained in the siloxane resin as the partial structure thereof are as follows: succinic anhydride, maleic anhydride, phthalic anhydride, pyromellitic anhydride, mellitic anhydride, tetracyanoethylene, tetracyanoquinodimethane, nitrobenzene, dinitrobenzene, trinitrobenzene, tetranitrobenzene, nitrobenzonitrile, picryl chloride, quinonechloroimide, chloranil, bromanil, benzoquinone, naphthoquinone, diphenoquinone, tropoquinone, anthraquinone, 1-chloro-anthraquinone, dinitroanthraquinone, 4-nitrobenzophenone, 4,4'-dinitrobenzophenone, 4-nitrobenzalmalondinitrile, α-cyano-β-(p-cyanophenyl)-2-(p-chlorophenyl)ethylene, 2,7-dinitrofluorene, 2,4,7-trinitrofluorenone, 2,4,5,7-tetranitrofluorenone, 9-fluorenylidenedicyanomethylenemalononitrile, polynitro-9-fluorenylidenedicyanomethylenemalono-dinitrile, picric acid, o-nitrobenzoic acid, p-nitrobenzoic acid, 3,5-dinitrobenzoic acid, pentafluorobenzoic acid, 5-nitrosalicylic acid, 3,5-dinitroalicylic acid, phthalic acid and mellitic acid.

In the invention, preferable charge transportable structural units are residues of usually used charge transporting compounds such as mentioned above. The residue is bonded with the bonding atom or group represented by Z through the carbon atom or the silicon atom constituting the charge transporting compound so as to be contained in the siloxane resin.

Formula 1

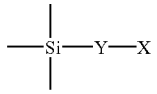

In the formula, X is a charge transferable structural unit, and Y is a bonding group having two or more valences.

Y in the formula 1 is-preferably an atom or group of two or more valents eliminating neighboring bonding atoms, i.e., silicon atom and carbon atom composing a part of above mentioned charge transferable structural unit.

When Y is three or more valent atom, the bonding hand other than those each bonding with Si and C is bonded with any atom constituting the hardened resin, or another atom or molecular group.

In the above-mentioned formula, the atom represented by Z is preferably an oxygen atom O, a sulfur atom S or nitrogen atom N.

In case that Y is a nitrogen atom, the above mentioned bonding group is —NR—, wherein R is hydrogen atom or monovalent organic group.

Although the charge transportable structural unit X is shown as a mono-valent group in the formula, the structural unit may be bonded as a two or more valences cross-linking group in the hardened resin or as a simple pendant group when the charge transporting compounds to be reacted with the siloxane resin has two or more functional groups.

The O, S or N atoms is a bonding atom or group for taking the charge transportable structural unit into the siloxane resin, which is formed by reaction of a hydroxyl group, mercapto group or amine introduced into the charge transportable compound with the organic silicon compound having a hydroxyl group or a hydrolyzable group.

Next, the charge transportable compounds having a hydroxyl group, a mercapto group, and an amine group, employed in the present invention, will be described.

The charge transportable compounds having a hydroxyl group as described herein are those having commonly employed structures, and in addition, also compounds having a hydroxyl group. Namely, representatively listed can be the charge transportable compounds represented by the general formula shown below, which bond to siloxane based organic silicone compounds and are capable of forming a resin layer. However, the compounds are not limited to the structure shown below, but may also be those having charge transportability as well as a hydroxyl group.

$$X—(R_7—OH)_m \quad m \geqq 1$$

wherein

X: structural unit providing charge transportability $R_7$: single bonding group, a substituted or unsubstituted alkylene group or a substituted or unsubstituted arylene group m: preferably 1 to 5

Representative examples are listed.
T-1
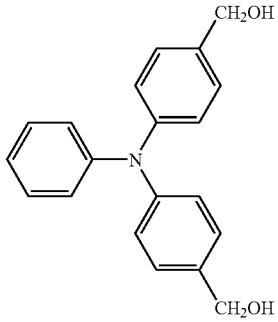
T-2
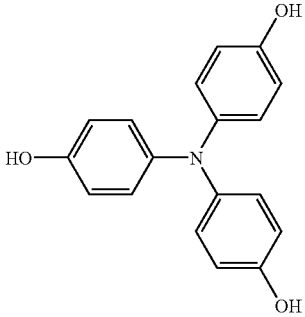
T-3
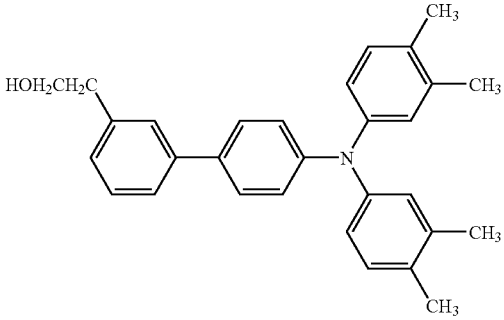
T-4
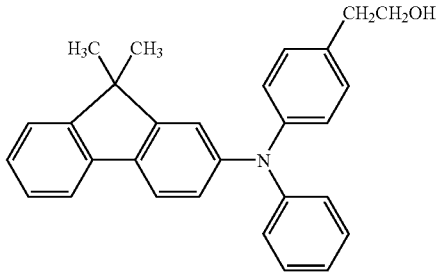
H-1
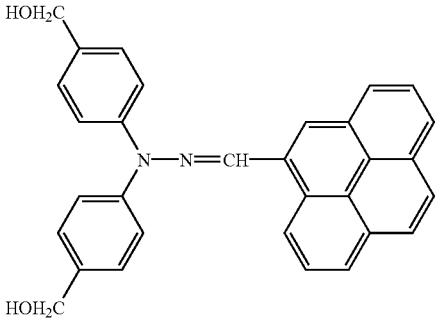
-continued
H-2
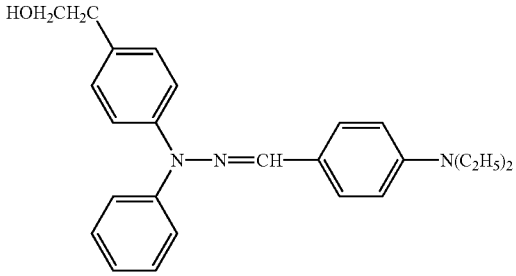
H-3
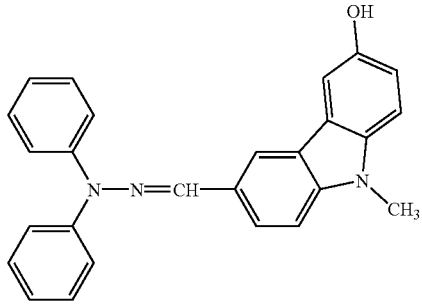
H-4
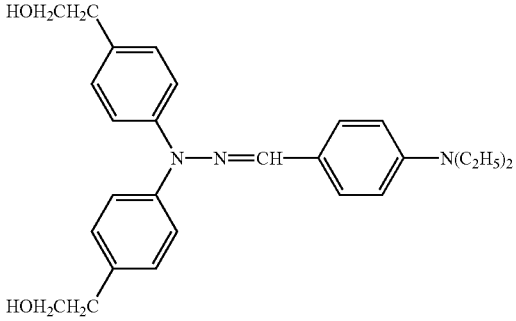
S-1
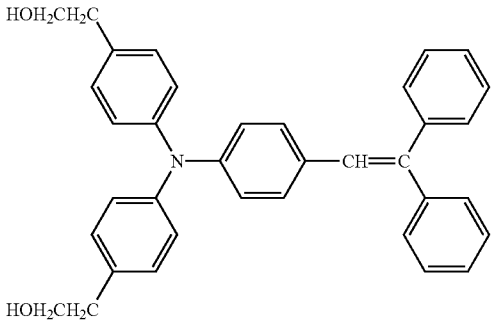

-continued
S-2
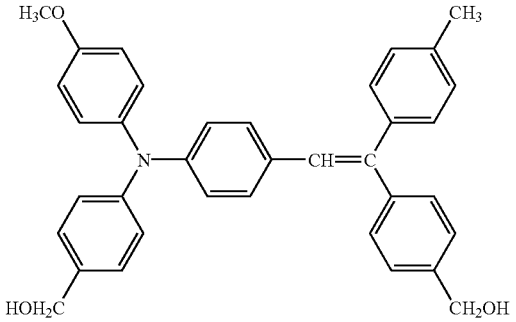
S-3
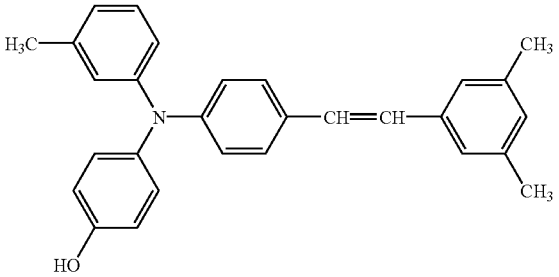
Be-1
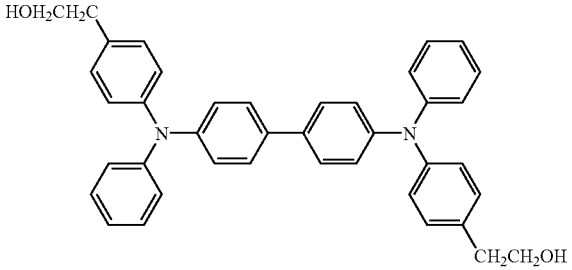
Be-2
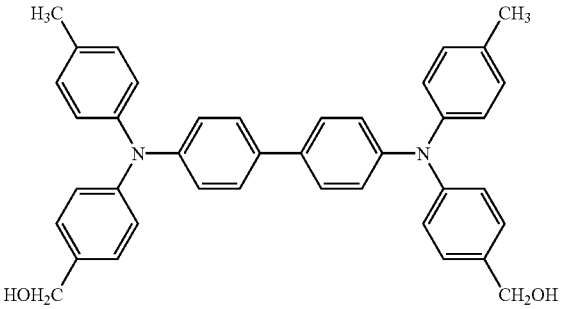
Be-3
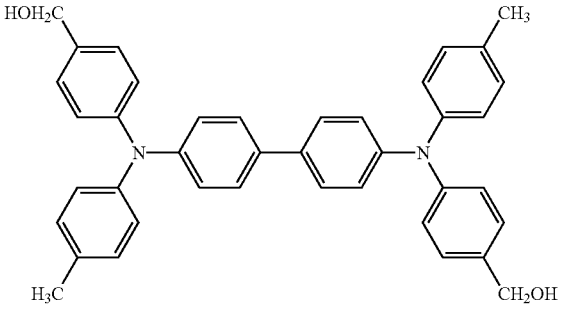
-continued
Bu-1
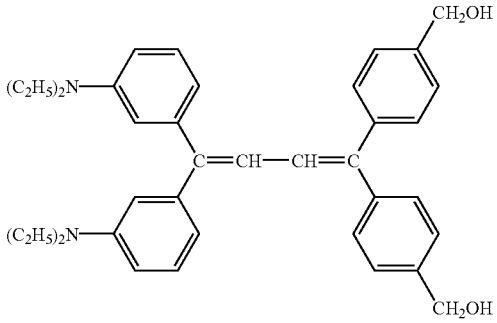
Bu-2
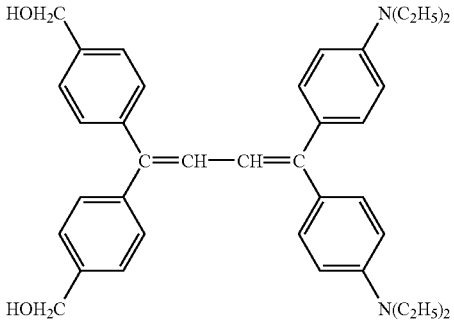
So-1
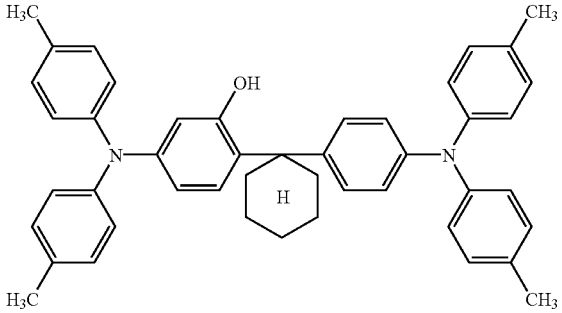
So-2
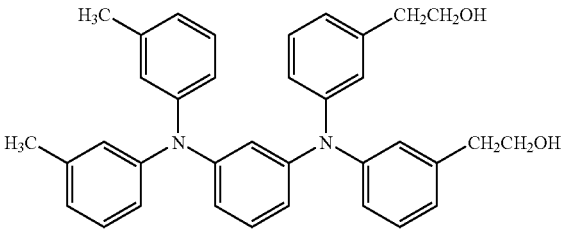

Next, a synthesis example of the charge transportable compound will be described.

Synthesis of Exemplified Compound T-1

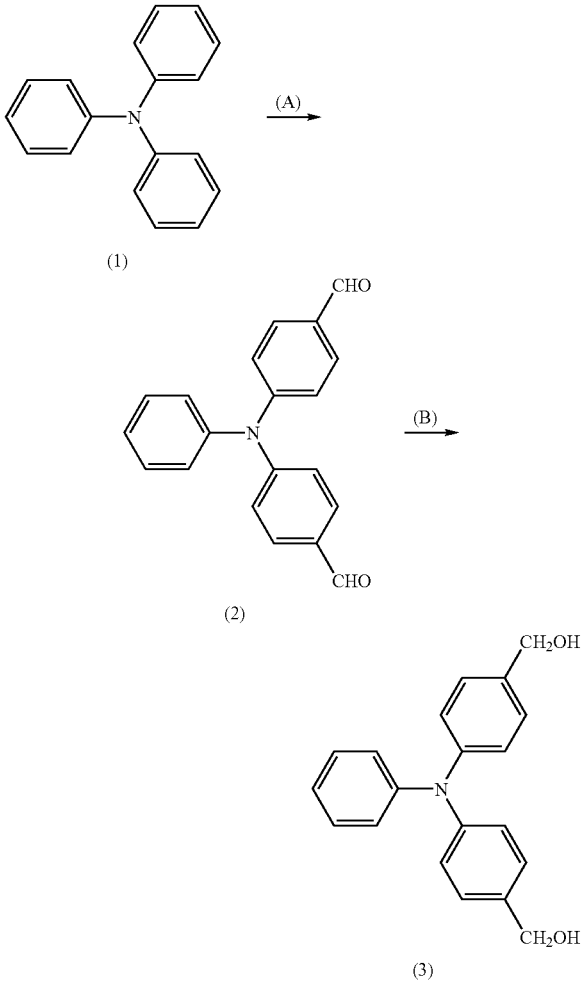

Step A

Placed in a four-neck flask equipped with a thermometer, a cooling tube, a stirrer, and a dropping funnel were 49 g of Compound (1) and 184 g of phosphorus oxychloride, which were heated and thereby dissolved. Employing the dropping funnel, 117 g of dimethylformamide was gradually added dropwise. Thereafter, the resulting mixture was stirred for about 15 hours while the temperature of the reacting solution was maintained between 85 and 95° C. Subsequently, the reaction solution was gradually poured into warm water, having a much larger volume than the same, and the resulting mixture was slowly cooled while stirring.

Deposited crystals were collected through filtration, then dried, and thus Compound (2) was obtained by purifying the resulting deposits through the adsorption of impurities employing silica gel and the like, and recrystallization employing acetonitrile. The yield was 30 g.

Step B

Placed in a flask were 30 g of Compound (2) and 100 ml of ethanol, and the resulting mixture was stirred. After gradually adding 1.9 g of sodium boron hydride, the resulting mixture was stirred for 2 hours while maintaining the temperature between 40 and 60° C. Subsequently, the reaction solution was poured into about 300 ml of water, and crystals were deposited while stirring. The deposited crystals were collected with filtration, well washed, and dried to obtain Compound (3). The yield was 30 g.

Synthesis of Exemplified Compound S-1

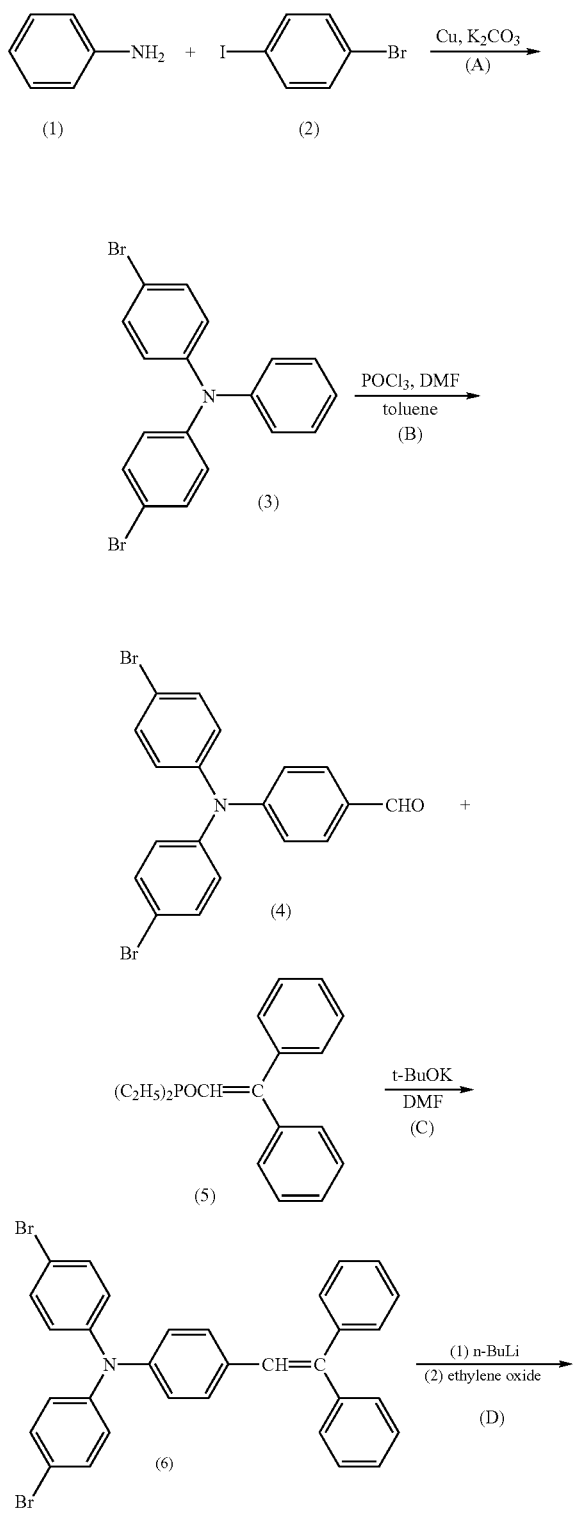

-continued

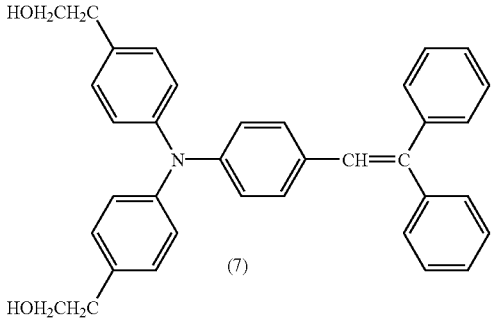

(7)

Step A

Placed in a 300 ml flask equipped with a thermometer and a stirrer were 30 g of Cu, 60 g of $K_2CO_3$, 8 g of Compound (1), and 100 g of Compound (2) and the resulting mixture was heated to about 180° C., and then stirred for 20 hours. After cooling, reaction products were collected through filtration and subjected to column purification to obtain 7 g of Compound (3).

Step B

A 100 ml flask equipped with a thermometer, a dropping funnel, an argon gas introducing unit, and a stirrer was filled with argon gas. Placed in said flask were 7 g of said Compound (3), 50 ml of toluene, and 3 g of phosphoryl chloride. Added slowly to the resulting mixture was dropwise 2 g of DMF and the resulting mixture was then heated to about 80° C. and stirred for 16 hours. The resultant was poured into about 70° C. water and then cooled. The resulting mixture was subjected to extraction employing toluene. The extract was washed until the pH of the wash water became 7. The resulting extract was dried employing sodium sulfate, then concentrated, and was then subjected to column purification to obtain 5 g of Compound (4).

Step C

Placed in a 100 ml flask equipped with an argon gas introducing unit and a stirrer were 1.0 g of t-BuOK and 60 ml of DMF, and said flask was filled with argon gas. Added to the resulting mixture were 2.0 g of said Compound (4) and 2.2 g of Compound 5, and the resulting mixture was stirred at room temperature for one hour. The resultant was poured into water having a much larger volume than the same, and was then subjected to extraction employing toluene. The resulting extract was water washed, and then dried employing sodium sulfate. Thereafter, the dried extract was concentrated, and subjected to column purification to obtain 2.44 g of Compound (6).

Step D

Placed in a 100 ml flask equipped with a thermometer, a dropping funnel, an argon gas introducing unit, and a stirrer was toluene, and the flask was then filled with argon gas. To this, 15 ml of a hexane solution (1.72 M) of n-BuLi was added and the resulting mixture was heated to 50° C. Added dropwise to said resulting mixture was a solution prepared by dissolving 2.44 g of Compound (6) in 30 ml of toluene, and the resulting mixture was stirred for 3 hours while maintaining the temperature at 50° C. After cooling the resulting mixture to −40° C., 8 ml of ethylene oxide were added, heated to −15° C. and stirred for-one hour. Thereafter, the resulting mixture was heated to room temperature, and mixed with 5 ml of water, subjected to extraction employing 200 ml of ether. The resulting extract was washed with saturated salt water. After washing until the pH of the washing water became, the extract was dried employing sodium sulfate, concentrated and subjected to column purification to obtain 1.0 g of Compound (7).

Next, specific examples of charge transportable compounds having a mercapto group will be illustrated below.

The charge transportable compounds having a mercapto group as described herein are charge transport compounds having commonly employed structures, as well as compounds having a mercapto group. Namely, representatively listed can be the charge transportable compounds represented by the general formula described below, which bond to organic silicone compounds and are capable of forming a resin layer. However, the compounds are not limited to the structure described below but may also be those having charge transportability as well as a mercapto group.

$$X—(R_8—SH)_m \quad m \geqq 1$$

wherein

X: charge transportability providing group $R_8$: single bonding group, a substituted or unsubstituted alkylene or arylene group m: preferably 1 to 5

Of these, listed as representative compounds are such as those described below.

V-1

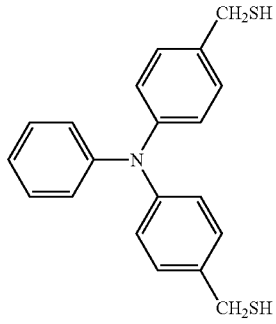

V-2

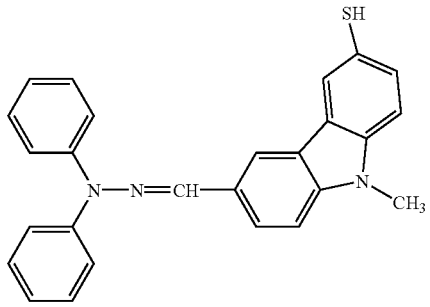

V-3

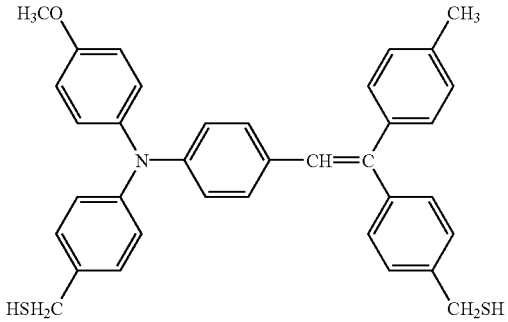

-continued

V-4

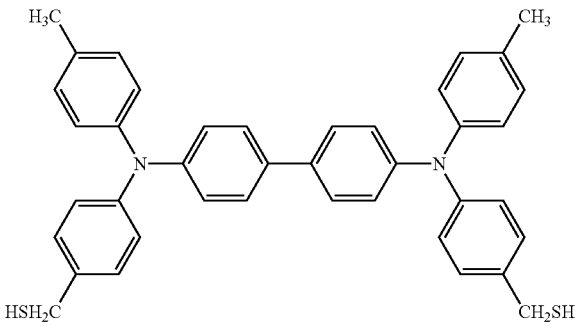

V-5

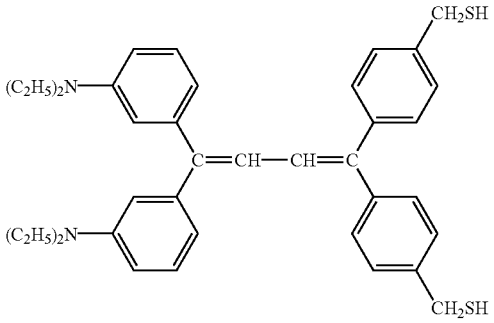

Further, specific examples of charge transportable compounds having an amino group are illustrated below.

The charge transportable compounds having an amino group as described herein are charge transport compounds having commonly employed structures, as well as compounds having an amino group. Namely, representatively listed can be the charge transportable compounds represented by the general formula described below, which bond to organic silicone compounds and are capable of forming a resin layer. However, the compounds are not limited to the structure described below but may be those having charge transportability as well as an amino group.

$$X—(R_9—NR_{10}H)m \quad m \geqq 1$$

wherein

X: charge transportability providing group $R_9$: single bonding group, a substituted or unsubstituted alkyl group or a substituted or an unsubstituted aryl group $R_{10}$: H, a substituted or unsubstituted alkyl group, or a substituted or unsubstituted aryl group m: 1 to 5

Of these, listed as representative compounds are such as those described below.

W-1

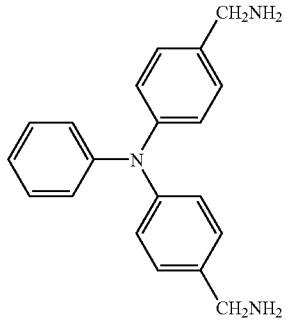

W-2

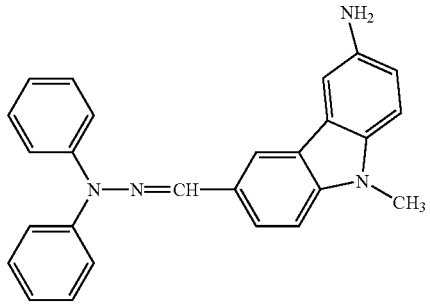

W-3

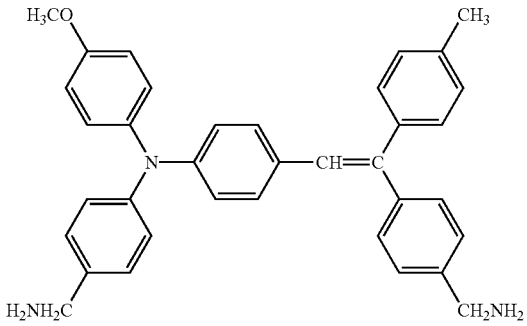

W-4

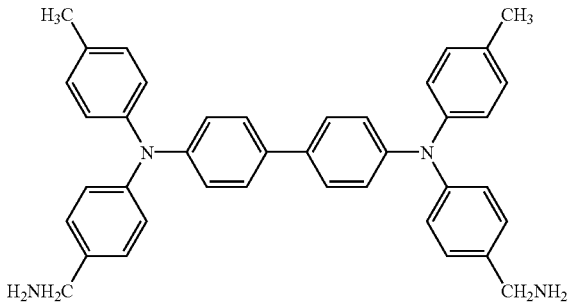

-continued

W-5

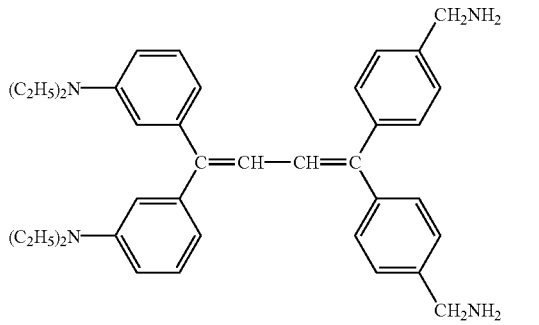

W-6

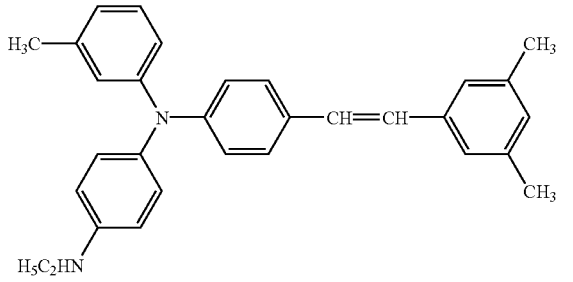

Of charge transportable compounds having an amino group, in the case of primary amine compounds (—$NH_2$), two hydrogen atoms may react with the organic silicone compound, and bonding to the siloxane structure may take place. In the case of secondary amine compounds (—$NHR_{10}$), one hydrogen atom may react with the organic silicone compound, and the remaining $R_{10}$ may be any of a remaining group as a branch, a group resulting in a crosslinking reaction, or a compound group having charge transportability.

The charge transferable compound containing silicon-atom-containing group is described.

The charge transferable compound containing silicon-atom-containing group is a compound having structure described below. The compound can be form a resin layer by bonding to hardenable organic silicon compound.

$$X\text{-}(\text{-}Z\text{-}Si(R_{11})_{3-a}(R_{12})_a)_n$$

In the formula, X is a group having a charge transferable structural unit, $R_{11}$ is hydrogen atom, a substituted or unsubstituted alkylene or arylene group, $R_{12}$ is a hydrolysable group or a hydroxyl group, Z is a substituted or unsubstituted alkylene or arylene group. A is an integer of 1 to 3, n is an integer.

Raw materials of the siloxane resin: The compounds represented Formula A through D (hereinafter referred to A through D) respectively. The ratio of those is preferably to use organic silicon compound: from 0.05 to 1 moles of C+D component per 1 mole of A+B component.

When colloidal silica E is added, it is preferable to use from 1 to 30 parts by weight of E per 100 parts by weight of total amount of A+B+C+D component.

The adding amount of the reactive charge transportable compound F capable of forming the resin layer by reacting with the organic silicon compound and the colloidal silica is preferably from 1 to 500 parts by weight per 100 parts by weight of the total amount of the component of A+B+C+D. When the amount of A+B component is smaller than the above-mentioned range, the hardness of the siloxane resin layer is shortened since the cross-linking density is too low. When the amount of A+B component is too large, the hardness of the layer is sufficient but the layer is become fragile. A shortage and an excess of the colloidal silica component E show similar effects to those of the component A+B, respectively. A too small amount of component F causes lowering in the sensitivity and raising in the remained potential since the charge transporting ability of the siloxane resin layer is become too low. When the amount of component F is excessive, the strength of the resin layer tends to be lowered.

The cross-linked siloxane resign having the charge transporting ability according to the invention may be prepared by forming a three-dimensional network structure by formation of a new chemical bond by adding a catalyst or a cross-linking agent to a monomer, an oligomer or a polymer each previously having a siloxane bond in the structural unit thereof. The resin may also be prepared by forming three-dimensional network structure by acceleration of the siloxane bonding of a monomer, an oligomer of a polymer by a hydrolyzing reaction and a dehydration condensation reaction thereafter.

Usually, the three-dimensional network structure can be formed by a condensation reaction of a composition containing alkoxysilane or alkoxysilane and colloidal silica.

Examples of the catalyst for forming the three-dimensional network structure include an organic carboxylic acid, nitrous acid, sulfurous acid, aluminic acid, a carbonate or thiocyanate of an alkali metal, an organic amine salt such as tetramethylammonium hydroxide and tetramethylammonium acetate, an organic tin compound such as stannous octate, dibutyl tin dictate, dibutyl tin dilaurate, dibutyl tin mercaptide, dibutyl tin thiocarboxylate and dibutyl tin maleate, an aluminum or zinc salt of octenic acid or naphthenic acid and an acetylacetone complex.

The following organic and inorganic particles may be used together with or in the place of the foregoing colloidal silica in the resin layer.

<Organic Particle>

Examples of the material of the foregoing organic particle include a silicone resin, a poly(tetrafluoroethylene), a poly (fluorized vinylidene), a poly(ethylene trifluoride chloride), a poly(vinyl fluoride), an ethylene tetrafluoride/propylene hexafluoride copolymer, an ethylenetetrafluoride/propylene hexafluoride copolymer, an ethylene/ethylene trifluoride copolymer, an ethylene tetrafluoride/propylene hexafluoride/perfluoroalkyl vinyl ether copolymer, a polyethylene, a poly(vinyl chloride), a metal stearate, a poly(methyl methacrylate), and melamine. The volume average diameter of the particle is preferably from 0.05 to 10 μm, more preferably from 0.1 to 5 μm. The amount of the organic particle contained in the resin layer is preferably from 0.1 to 100, more preferably from 1 to 50%, by weight of the amount of the resin of the layer. When the amount of the organic particle is less than 0.1%, a sufficient printing durability and lubricity cannot be given to the photoreceptor so that insufficient cleaning tends to be occurred at the time of image formation, and the adhesion with the lower layer id not improved. When the content of the organic particle exceeds 10% by weight, the sensitivity of the photoreceptor is lowered and the fog tends to be formed.

<Inorganic Particle>

Examples of the material of the inorganic particle include a metal oxide such as magnesium oxide, calcium oxide, titanium oxide, zirconium oxide, tin oxide, aluminum oxide, silicon oxide (silica), indium oxide, beryllium oxide, lead oxide, and bismuth oxide; a nitride such as boron nitride, aluminum nitride, and silicon nitride; and a carbide such as silicon carbide, and boron carbide. The inorganic particle may preferably be subjected to a hydrophobilizing treatment by a hydrophobilizing agent such as a titan coupling agent, a silane coupling agent an aluminum coupling agent and a high molecular fatty acid.

The diameter of the inorganic particle is preferably from 0.05 to 10 μm, more preferably from 0.1 to 5 μm, in volume average diameter. The amount of the inorganic particle to be contained in the surface layer of the photoreceptor is preferably from 0.1 to 100% by weight, more preferably from 1 to 50%, by weight of the binder in the surface layer. When the content is less than 0.1%, a sufficient print durability, mechanical strength, and adhesiveness with the lower layer cannot be obtained and the surface of the photoreceptor tends to be abraded and damaged at the time of the image formation. When the content exceeds 100% by weight, the roughness of the surface of the photoreceptor is increased so that the cleaning member is damaged and an insufficient cleaning is caused.

The volume average diameter of the organic and inorganic particles is measured by a laser diffraction/scattering grain size distribution measuring apparatus LA-700, manufactured by Horiba Seisakusho Co., Ltd.

The antioxidant in the invention is a substance preventing or inhibiting the action of oxygen to an automatically oxidizable substance existed at the surface of or in the photoreceptor under a condition accompanied with light, heat or electric discharge. The following compounds are described as the examples of the antioxidant.

(1) Radical Chain Reaction Stopping Agent

Phenol type antioxidant

Hindered phenol compounds

Amine type antioxidant

Hindered amine compounds

Diallyldiamine compounds

Diallylamine compounds

Hydroquinone type antioxidant (2) Peroxide Decomposing Agent

Sulfur compound type antioxidant (thioether compounds)

Phosphoric acid type antioxidant (phosphorous acid ester compounds)

Among the foregoing antioxidant, the radical chain reaction stopping agent of (1) particularly the hindered phenol compound and the hindered amine compound are preferred. Two or more kinds of the antioxidants may be used in combination, for example, the combination used of the hindered phenol antioxidant of (1) and the thioether compound of (2) are preferable. A compound having a hindered phenol structural unit and a hindered amine structural unit in the molecular thereof are also usable.

Among the foregoing antioxidants, the hindered phenol type and hindered amine type antioxidants are particularly effective for preventing the occurrence of fog and blur of image at a high temperature and humidity.

The content of the hindered phenol or the hindered amine antioxidant in the resin layer is preferably from 0.01 to 20% by weight. When the content is less than 0.01% by weight, the preventing effect to the occurrence of fog and blur of image at a high temperature and humidity cannot be obtained. When the content is exceeds 20% by weight, the charge transportation ability of the resin layer is lowered and the remaining potential tends to be increased, moreover the strength of the layer is lowered.

The antioxidant may be added to an electric charge generation or a charge transportation layer provided as the lower layer and an interlayer according to necessity. The adding amount of the antioxidant to such the layers is each preferably from 0.01 to 20% by weight.

The hindered phenols as described herein means compounds having a branched alkyl group in the ortho position relative to the hydroxyl group of a phenol compound and derivatives thereof. (However, the hydroxyl group may be modified to an alkoxy group.)

The hindered amines are compounds having an organic bulky group neighboring to nitrogen atom. An example of the bulky group is branched alkyl group, preferable example of which is t-butyl group. The preferable examples of the compounds having organic group are those represented by the following structural formula:

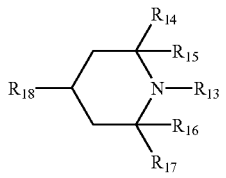

wherein $R_{13}$ represents a hydrogen atom or a univalent organic group, $R_{14}$, $R_{15}$, $R_{16}$, and $R_{17}$ each represents an alkyl group, and $R_{18}$ represents a hydrogen atom, a hydroxyl group, or a univalent organic group.

Listed as antioxidants having a partial hindered phenol structure are compounds described in Japanese Patent Publication Open to Public Inspection No. 1-118137 (on pages 7 to 14).

Listed as antioxidants having a partial hindered amine structure are compounds described in Japanese Patent Publication Open to Public Inspection No. 1-118138 (on pages 7 to 9).

Examples of the organic phosphorous compounds, represented by formula RO—P(OR)—OR, are listed below. In the formula R is hydrogen atom, or a substituted or unsubstituted alkyl, alkenyl or aryl group.

Examples of the organic sulfur compounds, represented by formula R—S—R, are listed below. In the formula R is hydrogen atom, or a a substituted or unsubstituted alkyl, alkenyl or aryl group.

1-1
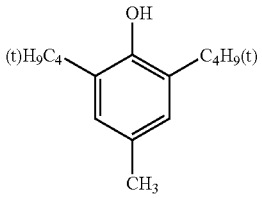
1-2
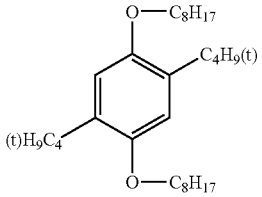
1-3
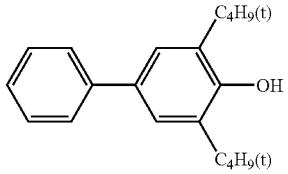
1-4
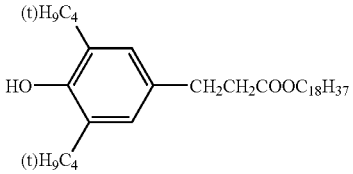
1-5
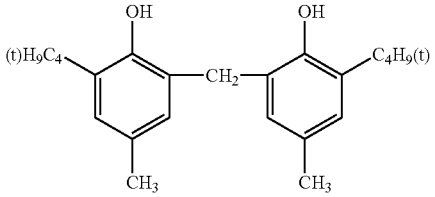
1-6
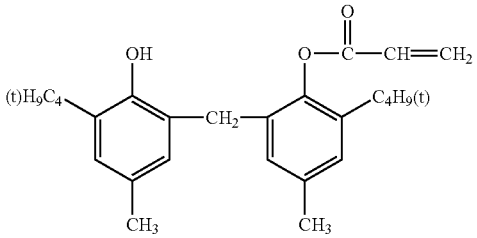
1-7
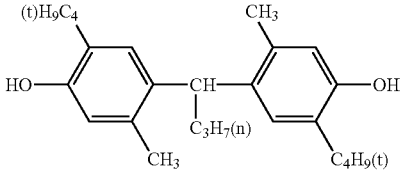
1-8
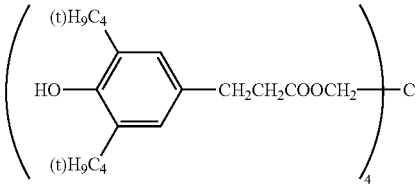

-continued
1-9
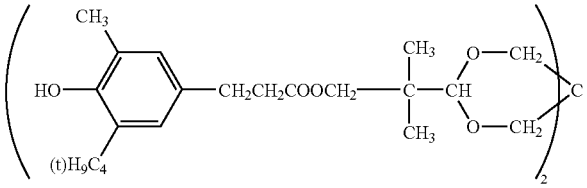
1-10
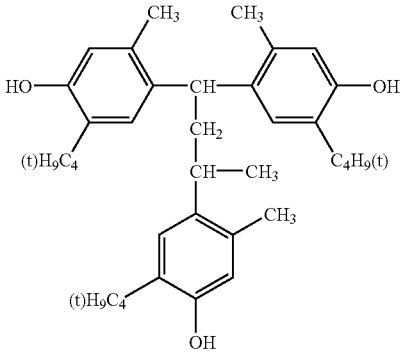
2-1
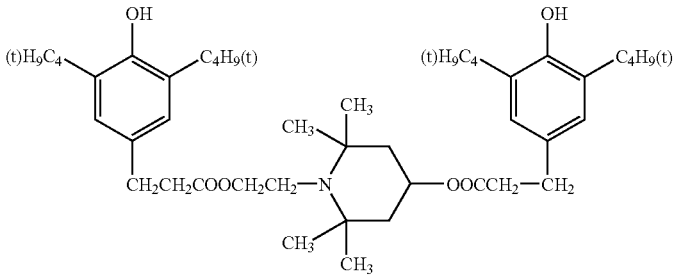
2-2
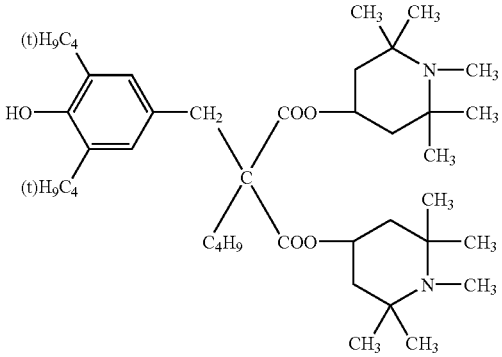
2-3
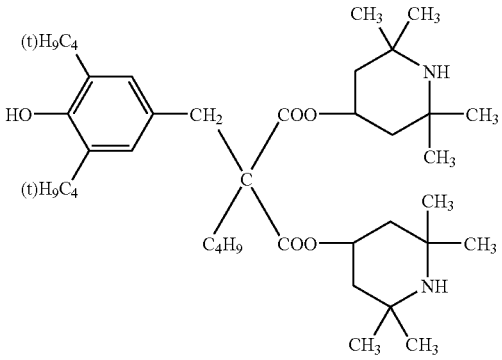

-continued
2-4
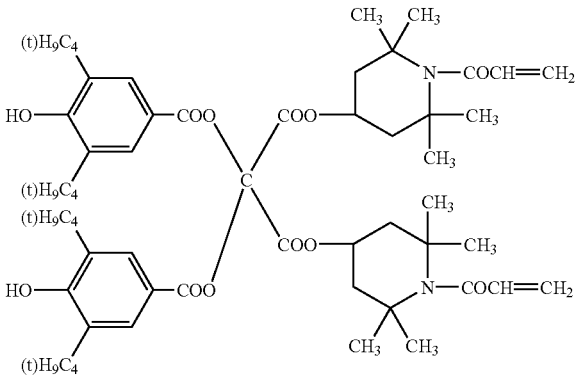
2-5
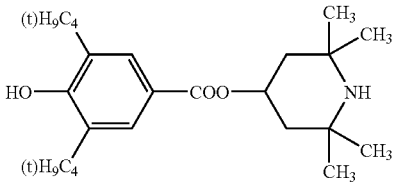
2-6
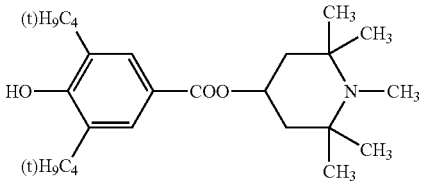
2-7
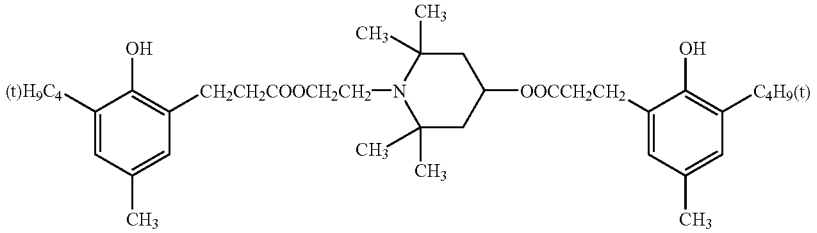
3-1
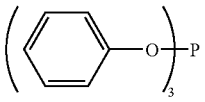
3-2
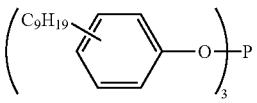
3-3
$(C_2H_5O)_3P$
3-4
$(C_8H_{17}O)_3P$
3-5
$(C_{10}H_{21}O)_3P$
3-6
$(C_{13}H_{27}O)_3P$
4-1
$(C_8H_{17}OCOCH_2CH_2)_2S$
4-2
$(C_{10}H_{21}OCOCH_2CH_2)_2S$
4-3
$(C_{12}H_{25}OCOCH_2CH_2)_2S$
4-4
$(C_{14}H_{29}OCOCH_2CH_2)_2S$ -continued 4-5

$(C_{18}H_{37}OCOCH_2CH_2)_2S$

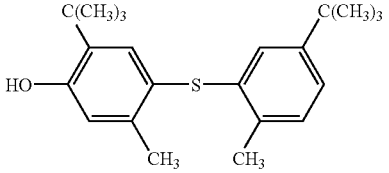

4-6

Examples of antioxidant available on the market include the followings.

Hindered phenol type antioxidant: IRGANOX 1076, IRGANOX 1010, IRGANOX 1098, IRGANOX 245, IRGANOX 1330, IRGANOX 3114, and 3,5-di-t-butyl-4-hydroxybiphenyl.

Hindered amine type antioxidant: Sanol LS2626, Sanol LS765, Sanol LS770, Sanol LS744, Tinuvin 144, Tinuvin 622LD, Mark LA57, Mark LA67, Mark LA62, Mark LA68 and Mark LA63.

The charge generating materials (CGM) incorporated into the photosensitive layer of the present invention may be employed individually or in combination with a suitable binder resin to form a resin layer. The representative examples of the charge generating materials include, for example, pyrylium dyes, thiopyrylium dyes, phthalocyanine pigments, anthanthrone pigments, dibenzpyrenequinone pigments, pyranthrone pigments, azo pigments, trisazo pigments, disazo pigments, indigo pigments, quinacridone pigments, cyanine dyes etc.

Charge transport materials (CTM) incorporated into the above-mentioned photosensitive layer include, for example, oxazole derivatives, oxadiazole derivatives, thiazole derivatives, thiadiazole derivatives, triazole derivatives, imidazole derivatives, imidazolone derivatives, imidazoline derivatives, bisimidazolidine derivatives, styryl compounds, hydrazone compounds, benzidine compounds, pyrazoline derivatives, stilbene compounds, amine derivatives, oxazolone derivatives, benzothiazole derivatives, benzimidazole derivatives, quinazoline derivatives, benzofuran derivatives, acridine derivatives, phenazine derivatives, aminostilbene derivatives, poly-N-vinylcarbazole, poly-1-vinylpyrene, poly-9-vinylanthracene and the like. These charge transport materials are generally employed together with a binder to form a layer.

Binder resins, which are incorporated into a single-layered photosensitive layer, a charge generating layer (CGL) and a charge transport layer (CTL), include polycarbonate resins, polyester resins, polystyrene resins, methacrylic resins, acrylic resins, polyvinyl chloride resins, polyvinylidene chloride resins, polyvinyl butyral resins, polyvinyl acetate resins, styrene-butadiene resins, vinylidene chloride-acrylonitrile copolymer resins, vinyl chloride-maleic anhydride copolymer resins, urethane resins, silicon resins, epoxy resins, silicon-alkyd resins, phenol resins, polysilicone resins, polyvinyl carbazole etc.

Layer configuration of the photoreceptor according to the invention is described.

It is preferable that the resin layer according to the invention is applied on a photosensitive layer such as charge generating layer, charge transfer layer or charge generating transfer layer.

In the present invention, the ratio of the charge generating material in the charge generating layer to the binder resin is preferably between 1:5 and 5:1 in terms of weight ratio. Further, the thickness of the charge generating layer is preferably no more than 5 μm, and is more preferably between 0.05 and 2 μm.

Furthermore, the charge generating layer is formed by coating a composition prepared by dissolving the above-mentioned charge generating material along with the binder resin in a suitable solvent and subsequently dried. The mixing ratio of the charge transport materials to the binder resin is preferably between 3:1 and 1:3 in terms of weight ratio.

The thickness of the charge transport layer is preferably between 5 and 50 μm, and is more preferably between 10 and 40 μm. Furthermore, when a plurality of charge transport layers are provided, the thickness of the upper charge transport layer is preferably no more than 10 μm, and is preferably less than the total layer thickness of the charge transport layer provided under the upper layer of the charge transport layer.

Listed as solvents or dispersion media employed to produce the photoreceptor of the present invention are n-butylamine, diethylamine, ethylenediamine, isopropanolamine, triethanolamine, triethylenediamine, N,N-dimethylformamide, acetone, methyl ethyl ketone, methyl isopropyl ketone, cyclohexanone, benzene, toluene, xylene, chloroform, dichloromethane, 1,2-dichloroethane, 1,2-dichloropropane 1,1,2-trichloroethane, 1,1,1-trichloroethane, trichloroethylene, tetrachloroethane, tetrahydrofuran, dioxolane, dioxane, methanol, ethanol, butanol, isopropanol, ethyl acetate, butyl acetate, dimethylsulfoxide, methyl cellosolve, and the like, however the present invention is not limited these. Of these, most preferably employed are dichloromethane, 1,2-dichloroethane or methyl ethyl ketone. Furthermore, these solvents may be employed individually or in combination of two types or more.

Next, listed as an electrically conductive support of the electrophotographic photoreceptor of the present invention is:

1) metal plates such as an aluminum plate, a stainless steel plate, and the like
2) those in which a thin layer of metal such as aluminum, palladium, gold, and the like is provided on a support such as paper, plastic film, and the like, employing lamination or vacuum evaporation
3) those in which the layer of an electrically conductive compound such as an electrically conductive polymer, indium oxide, tin oxide, and the like is provided on a support such as paper, plastic film, and the like, employing coating or vacuum evaporation, and the like.

Employed mainly as materials for the electrically conductive support employed in the present invention are metals such as aluminum, copper, brass, steel stainless steel, and the like, as well as plastics. Any of these is processed in a belt shape or drum shape, and then employed. Commonly thin-walled cylindrical aluminum tubes produced by extrusion or drawing are frequently employed.

An electric conductive support having anodized aluminum film subjected to sealing process on the surface thereof may be employed. The anodizing process is conducted usually in acidic bath, for example, chromic acid, sulfuric acid, Succinic acid, phosphoric acid, boric acid and sulfamic acid, and most preferable example is anode oxidation process in sulfuric acid. In this instance, it is conducted preferably at condition that content of sulfuric acid is 100 to 200 g/l, content of aluminum ion is 1 to 10 g/l, temperature of bath is around 20 C, and application voltage is 20 volts. The preferable average film thickness is usually 20 μm or less, particularly preferably 10 μm or less.

Next, employed as coating methods to produce the electrophotographic photoreceptor of the present invention may be a dip coating method, a spray coating method, a circular amount regulating type coating method, and the like. In order to minimize the dissolution of the lower layer surface during coating of the surface layer side of the photosensitive layer, as well as to achieve uniform coating, the spray coating method or the circular amount control type coating method (being a circular slide hopper type as its representative example) is preferably employed. Further, the above-mentioned spray coating is, for example, described in Japanese Patent Publication Open to Public Inspection Nos. 3-90250 and 3-269238, while the above-mentioned circular amount control type coating is detailed in, for example, Japanese Patent Publication Open to Public Inspection No.-58-189061.

In the present invention, an interlayer, functioning as a barrier, may be provided between the electrically conductive support and the photosensitive layer.

Listed as an interlayer are materials for the interlayer such as casein, polyvinyl alcohol, nitrocellulose, ethylene-acrylic acid copolymer, polyvinyl butyral, phenol resins, polyamides (nylon 6, nylon 66, nylon 610, copolymerized nylon, alkoxymethylated nylon, etc.), polyurethane, gelatin and aluminum oxide, or hardening type interlayers employing metal alkoxides, organic metal complexes, silane coupling agents as described in Japanese Patent Publication Open to Public Inspection No. 9-68870. The thickness of the interlayer is preferably between 0.1 and 10 μm, and is most preferably between 0.1 and 5 μm.

The shape of the photoreceptor is in a belt , sheet, or drum shape, as far as it is suitable to adapt the electrophotographic apparatus.

The process of image formation and the structure of the apparatus are described according to FIG. 1.

FIG. 1 shows the schematic cross section of a color image forming apparatus 100 which is one of embodiments of the invention.

This example is an apparatus having a drum-shaped intermediate transfer member (also referred to as an intermediate transfer means), by which color toners of the developers are imagewise overlapped to form a color image and the color image is transferred onto a image receiving material (Paper P).

The intermediate transfer member generally has a multi-layered structure, for example, the intermediate transfer member comprises an electroconductive substrate and an elastic layer composed of an elastic substance such as rubber, elastomer or resin and a covering layer provided on the substrate. The shape of the intermediate transfer member may be optionally selected without any limitation, for example, those having roller shape and a belt shape are suitable.

A polyurethane resin, a polyester resin, a polystyrene resin, a polyolefin resin, a polybutadiene resin, a polyamide resin, a poly(vinyl chloride) resin, a polyethylene resin, and a fluorinated resin, in each of which an electroconductive carbon powder or a metal powder is dispersed, are suitably used as the material of the intermediate transfer member. Among them, the polyurethane resin in which the carbon particles are dispersed is suitable.

Figure 2:
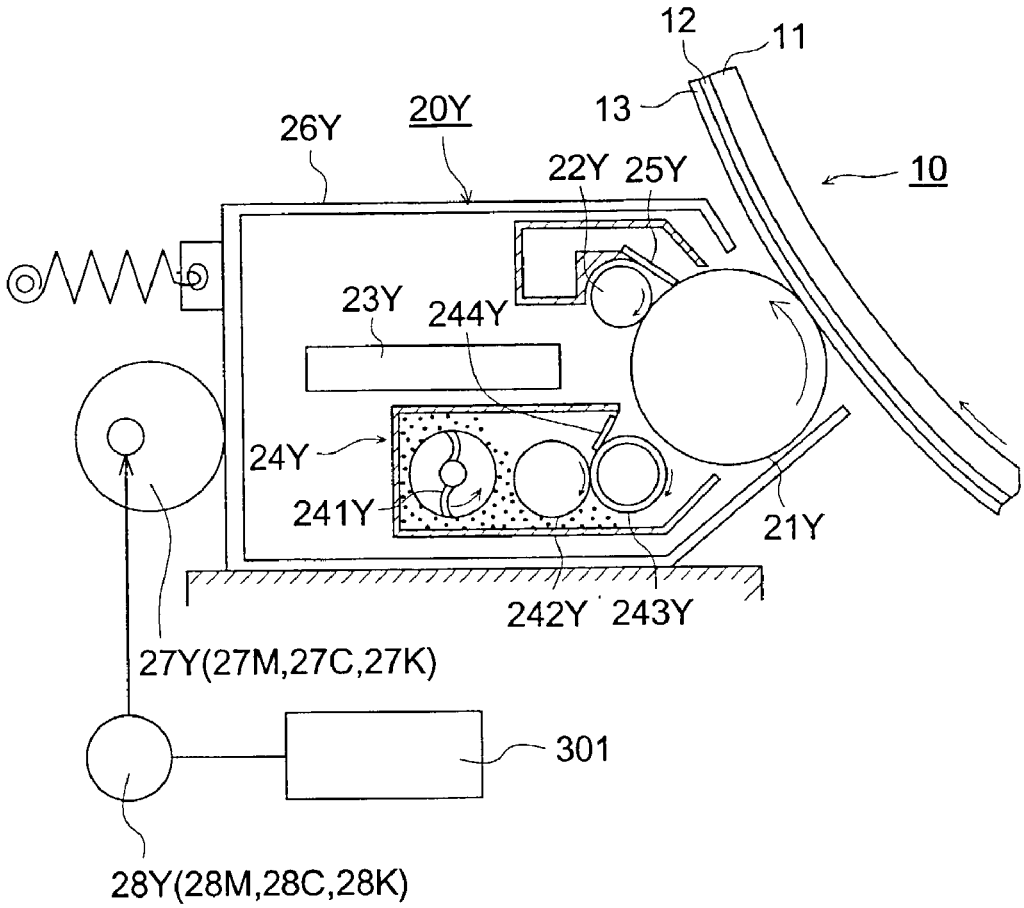
FIG. 2 shows a cross section of an image forming unit according to the invention.

The surface volume resistivity of the intermediate transfer member is preferably from $10^8$ to $10^{16}$ Ω·cm. When the surface volume resistivity of the intermediate transfer member is less than $10^8$ Ω·cm, the image is undesirably blurred or grown. When the surface volume resistivity exceeds $10^{16}$ Ω·cm, the scatter of the image and the necessity of charge removing from the intermediate transfer sheet are occurred which are also undesirable. The thickness of the intermediate transfer member is preferably from 50 to 200 μm The intermediate transfer member (the intermediate transfer means) 10 carries toner images of yellow (Y), magenta (M), cyan (C) and black (K) which are each formed by four sets of image forming unit 20Y, 20M, 20C and 20K, respectively, and overlapped on the intermediate transfer member. The intermediate transfer member 10 is a drum-shaped intermediate transfer member 10 which is constituted by a cylindrical aluminum substrate 11 as is shown in FIG. 2, an electroconductive rubber layer 12 as the elastic layer (a layer of urethane rubber layer having a thickness of from 500 to 5,000 μm, an electroresistivity of from $10^8$ to $10^{14}$ Ω·cm) provided on the substrate, and a mold releasing film 13 (a layer of Teflon having a thickness of from 20 to 200 μm, an electroresistivity of from $10^{10}$ to $10^{16}$ Ω·cm) further provided on the elastic layer. The four sets of image forming units 20Y, 20M, 20C, and 20K, an image transfer means to the image receiving paper 30, and a intermediate transfer member cleaning means 16 are arranged around the intermediate transfer member 10. The intermediate transfer member 10 is rotatively held by an axle 101 on the color image forming apparatus 100.

The four sets of the image forming units 20Y, 20M, 20C, and 20K are each installed in frames 26Y, 26M, 26C, and 26K, respectively. The frames 26Y, 26M, 26C, and 26K are each arranged movably in the color image forming apparatus 100. Moving members 27Y, 27M, 27C, and 27K each connected to frames 26Y, 26M, 26C, and 26K, respectively, are provided for moving each of the frames from the position at which the image is transferred to the drum-shaped intermediate transfer member 10 to the position at which the image is not transferred.

The image forming units 20Y, 20M, 20C, and 20K are each constituted by photoreceptor drums 21Y, 21M, 21C, and 21K, and rotary charging means 22Y, 22M, 22C, and 22K, exposing means 23Y, 23M, 23C, and 23K, rotary developing means 24Y, 24M, 24C, and 24K, and cleaning means 25Y, 25M, 25C, and 25K for cleaning each the photoreceptor drums 21Y, 21M, 21C, and 21K, each arranged around the photoreceptor drums 21Y, 21M, 21C, and 21K, respectively.

The image forming units 20Y, 20M, 20C, and 20K each have the same structure except that the color of toner image formed on the intermediate transfer member 10 is different from each other. The image forming unit 20Y is described in detail according to FIG. 2 as an example.

The image forming unit 20Y installed in the frame 26Y is a unit to form a yellow (Y) toner image of the photoreceptor drum 21Y. The image forming unit 20Y is constituted by a photoreceptor drum 21Y as an image forming member, and the means for charging the image forming member 22Y, hereinafter referred to as the charging means 22Y or charging device 22Y, the exposing means 23Y, the developing means 24Y, and the means for cleaning the image forming member 25Y, hereinafter referred to as the cleaning means 25Y or the cleaning blade 25Y) each arrange around the photoreceptor drum 21Y. In an embodiment of the invention, at least the photoreceptor drum 21Y, charging means 22Y, the developing means 24Y, and the cleaning means 25Y are arranged so as to be unitized in the image forming unit 20Y.

The changing means 22Y is a means for providing a uniform potential to the photoreceptor drum 21Y. In the embodiment, a roller charging device 22Y having a shape of roller is used which is contacted with the photoreceptor drum 21Y and rotated accompanied with the photoreceptor drum.

The exposing means 23Y is a means for imagewise exposing to light the photoreceptor drum 21Y, on which the uniform potential is applied by the roller charging device 22Y, according to information of a yellow image to form a static latent image corresponding to the yellow image. As the exposing means 23Y, for example, a combination of LED elements arrayed in the axis direction of the photoreceptor drum 21Y and image focusing elements (commercial name: SELFOC lens), or a laser optical system are used.

The developing means 24Y is a means for accommodating the yellow toner and for forming a yellow toner image by reversal developing the static image formed on the photoreceptor drum 21Y. In the developing means 24Y of this embodiment, the yellow toner accommodated in the developing means 24Y is stirred by a stirring member 241Y and supplied to a developing sleeve 243Y by an elastic (sponge) toner supplying roller 242Y rotating in the direction of the arrow. The toner supplied on the developing sleeve 243Y is made to a thin layer by a thin layer forming member 244Y. At the time of development, a developing bias of a direct current or a direct current together with an alternative current each having a polarity the same as that of the toner is applied to the developing sleeve 243Y rotating in the direction of the arrow, and a non-contacting reversal development is performed on the grounded photoreceptor drum 21Y by an one-component developer by jumping development. Stopper rollers provided at the both ends of outside the image forming area of the developing sleeve hold the developing sleeve 243Y by touching with the photoreceptor drum 21Y, so as not to be contacted with the photoreceptor drum 21Y. Moreover, a contact development may be performed in stead of the non-contact development.

The yellow toner image formed on the photoreceptor drum 21Y is successively transferred onto the intermediate transfer member 10 to which a bias voltage having a reverse polarity to the charge of toner is applied while the stopper rollers are rotated by touching to the positioning portion of the photoreceptor drum 21Y.

The cleaning means 25Y is a means for removing the yellow toner remained on the photoreceptor drum 21Y after the transfer of the yellow toner image to the intermediate transfer member 10. In this embodiment, the cleaning means 25Y removes the remained toner by rubbing the photoreceptor drum 21Y.

Thus the yellow toner image corresponding to the yellow image signals formed by the image forming unit 20Y through the course of the charging, exposing and developing is transferred onto the intermediate transfer member 10.

In each of the image forming units 20M, 20C, and 20K, a magenta toner image corresponding to the magenta image signals, a cyan image corresponding to the cyan image signals and a black toner image corresponding to the black image signals are synchronously formed on the photoreceptor drums 21M, 21C, and 21B, respectively by parallel processing. The toner images formed by such the procedures on the photoreceptor drums 21M, 21C, and 21B of the image forming units 20M, 20C, and 20K are successively transferred onto the intermediate transfer member 10 to which a transferring bias of from 1 to 2 kV is applied to overlap the toner images. A color toner image is formed on the intermediate transfer member 10 when the all toner images are overlapped.

Besides, a paper supplying cassette CA is provided under the intermediate transfer member 10 as a means for accommodating image receiving material, and the image receiving paper P as the image receiving material is taken out from the paper supplying cassette CA by a paper supplying roller pair r1 and sent to a timing roller pair r2. The image receiving material (image receiving paper) P is transported by the timing roller pair 2*r* so as to be synchronized with the color toner image formed on the intermediate transfer member 10.

The color toner image formed on the intermediate transfer member 10 is transferred onto thus transported image receiving paper P at the transferring position by a means 30 for transferring image to the image receiving paper. The means 30 for transferring image to image receiving paper is constituted by a grounded roller 31, a transferring belt 32, a charging device for paper 33, a transferring electrode 34, and an AC discharging device for releasing paper 35.

The transported image receiving paper is transported to the transferring position by the transferring belt 32 which is put by a roller 31 and rotated in the direction of the arrow synchronized with the circumference speed of the intermediate transfer member 10. The transferring belt 32 is a belt-shaped device having a high electroresistivity of from $10^6$ to $10^{10}$ Ω·cm. The image receiving paper P is charged with the polarity the same as that of the toner by a paper charging device and absorbed to the transferring belt 32, then transported to the image transferring position. Damages on the color image caused by the attraction force between the image receiving paper and the color toner image formed on the intermediate transfer member 10 is prevented by charging the image receiving paper with the charge having the same polarity as that of the toner. An electroconductive roller or a brush charging device each capable of contacting with and releasing from the transferring belt 32 may be used as the means for charging the image receiving paper.

The color toner image on the intermediate transfer member 10 is transferred onto the image receiving paper P at the transferring position by the transferring electrode 34. Corona discharge is applied from the transferring electrode 34 to the back side of the image receiving paper so that the potential of from 1.5 to 3 kV is generated, which is higher than the bias to the intermediate transferring member 10 and is reverse in the polarity to the bias.

The image receiving paper P on which the color toner image is transferred is further transported by the transferring belt 32 and is discharged by the paper releasing AC discharging device 35 for releasing the image receiving paper P. The image receiving paper P is released from the transferring belt and transported to a fixing means 40. In the fixing means 40, the color toner image is molten and fixed on the image receiving paper P by heating and pressing by a heating roller 41 and pressing roller 42. Then the image receiving paper P is output by an outputting roller pair r3 onto a tray provided at an upper portion of the color image forming apparatus.

On the other hand, the intermediate transfer member 10 is cleaned by removing the toner remained thereon by rubbing by a cleaning blade 161 as the cleaning means 16 after the color toner image is transferred to the image receiving paper P. A blade is attached to the transferring belt 32 as the transfer belt cleaning means 36 for cleaning the transferring belt after releasing the paper.

Figure 3:
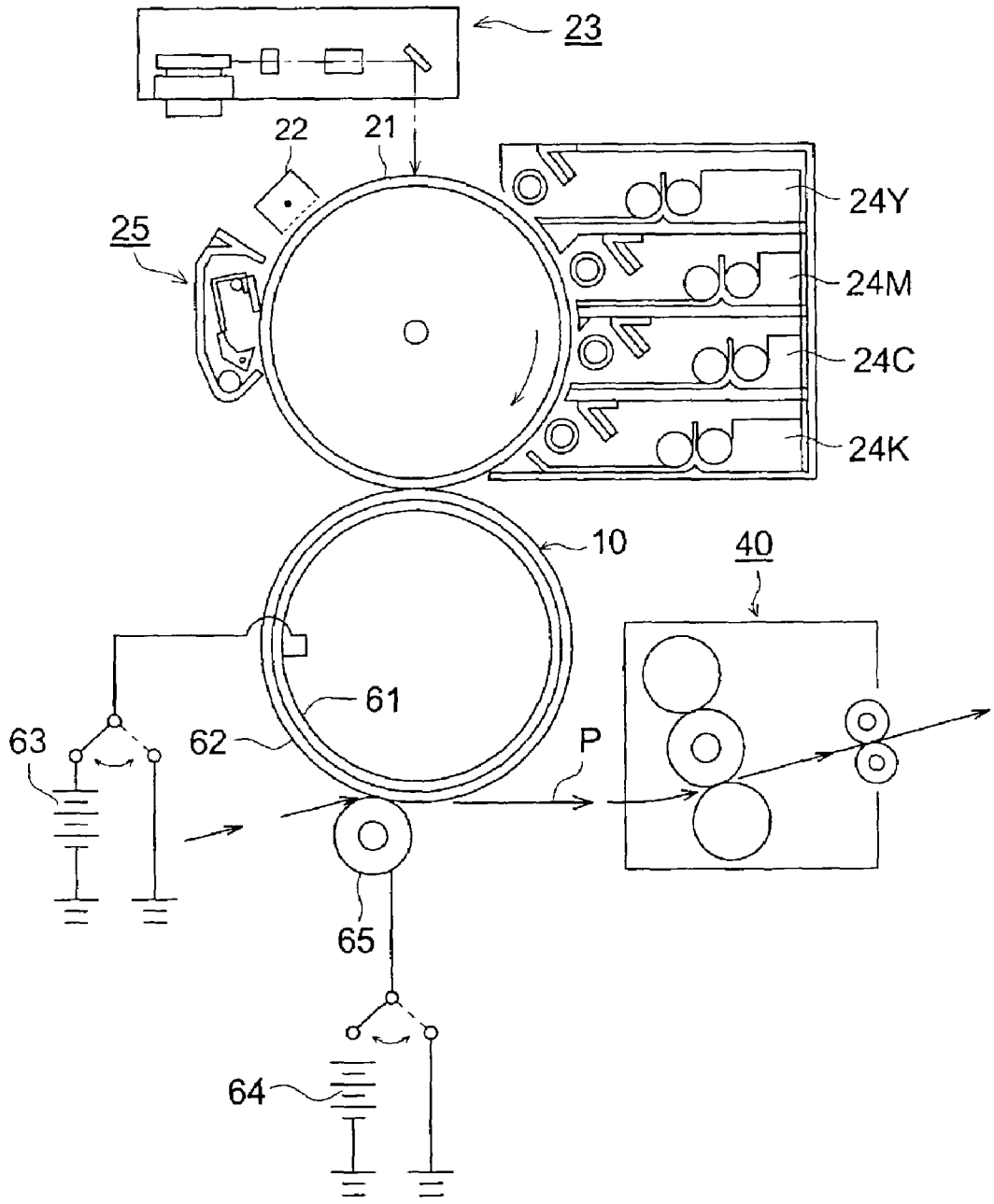
FIG. 3 shows a cross section of anther example of the image forming unit according to the invention.

FIG. 3 shows a cross section of the structure of another color image forming apparatus.

This embodiment is an image forming apparatus to form a color toner image on the transfer member.

A charging means 22, an exposing means 23 having a laser light source, a yellow developing means 24Y, a magenta developing means 24M, a cyan developing means 24C, black developing means 24K, and a cleaning means 25 are arranged around a photoreceptor drum 21 which is clockwise rotated in the direction shown by the arrow. An electroconductive substrate 61 composed of a metal drum and an intermediate transfer member 10 having a layer 62 containing an electroconductive metal oxide according to the invention are arranged so as to contact to the photoreceptor drum 21. Transferring voltage is applied from a power source 63 to the electroconductive substrate 61 of the intermediate transfer member. A transferring roller 65 for transferring the toner image formed on the intermediate transfer member 10 to the image receiving material is arranged at a position just under the position at which the toner image is transferred from the photoreceptor drum 21 to the intermediate transfer member 10. Voltage for transferring the toner image from the intermediate transfer member 10 to the image receiving material is applied by a power source 64.

The photoreceptor drum 21 cleaned by the cleaning means 25 is uniformly charged by the charging means 22 and image wise exposed to light by the exposing means 23 so that a static latent image of the yellow image is formed on the surface of the photoreceptor drum 21. The static latent image of the yellow image is developed by the yellow developing means 24Y. At this time the magenta developing means 24M, the cyan developing means 24C, and the black developing means 24K are in the paused state so as not to influence to the development by the yellow toner. The yellow toner image is transferred to the intermediate transfer member 10 at the position at which the photoreceptor drum 21 is touched to the intermediate transfer member 10. The transfer is performed in an electrostatic field applied by a power source 63. After the transfer, the photoreceptor drum 21 is cleaned by the cleaning means 25, charged again by the charging means 22, and imagewise exposed to light corresponding to a magenta image by the exposing means 23 so as to form a static latent image of the magenta image on the surface of the photoreceptor drum 21. Then a magenta image is formed by the magenta developing means 24, and transferred onto the intermediate transfer member 10.

After that, a cyan toner image and a black toner image are formed and transferred onto the intermediate transfer member 10 in the course of the third and fourth rotations of the photoreceptor drum 21, respectively. These toner images are overlapped on the intermediate transfer member 10 to form a color toner image. Transfer voltage is applied to a transfer roller 65 from a power source 64 when the color toner image is arrived at the position of the transfer roller 56. Besides, the image receiving material P is supplied at the time of arrival of the toner image at the position of the transfer roller 65. The color toner image is transferred onto the image receiving material P through the transfer roller 65 by the transfer voltage supplied from the power source 64. The color toner image transferred onto the image receiving material P is fixed by a fixing means 40.

Figure 4:
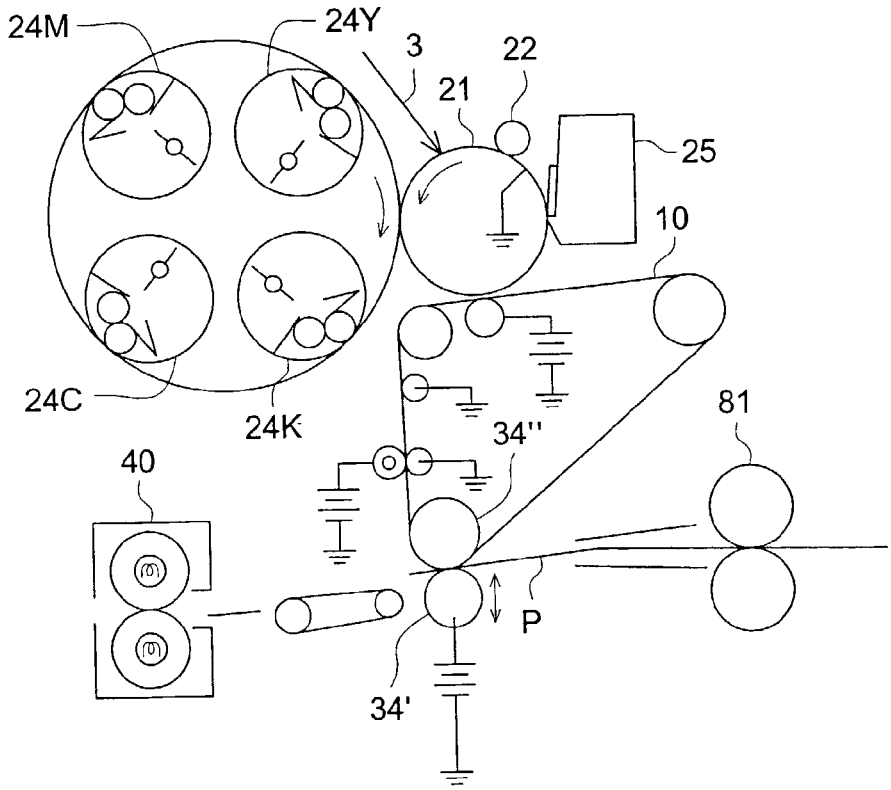
FIG. 4 shows a cross section of another image forming unit according to the invention.

FIG. 4 shows a cross section of another color image forming apparatus such as a copier or a laser beam printer. A belt-shaped intermediate transfer member 10 is comprised of a elastic material having a medium resistivity.

Symbol 21 is a rotary photoreceptor drum which is driven so as to be counterclockwise rotated as show by the arrow at a prescribed circumference speed.

In the course of the rotation of the photoreceptor drum 21, the drum is uniformly charged at a prescribed potential and polarity by a charging means 22, and imagewise exposed to light by scanning of a laser beam modulated corresponding to time serial electric digital pixel signals of an image information by a exposing means, not shown in the figure, so as to form a static latent image corresponding to the yellow color component of the subjected color image.

The static latent image is developed with a yellow toner as the first color by a yellow developing means 24Y. At this time, the second through fourth developing means 24M, 24C, and 24K (magenta, cyan, and black developing means) are in a paused state and do not affect to the photoreceptor drum 21. Accordingly, the first yellow toner image is not influenced by the second through fourth developing means.

The intermediate transfer member 10 is driven so as to be clockwise rotated with a circumference speed the same as that of photoreceptor drum 21.

The yellow toner, the first color, image formed and carried on the photoreceptor drum 21 is intermediately transferred onto the circumference surface of the intermediate transfer member 10 (primary transfer) by an electric field generated by the primary transferring bias applied from the primary transferring roller to the intermediate transfer member 10 in the course of passing the yellow toner image through the nip portion between the photoreceptor drum 21 and the intermediate transfer member 10.

The surface of the photoreceptor drum 21 is cleaned by a cleaning device 25 after the yellow toner image, as the first color, is transferred onto the intermediate transfer member 10.

Then a magenta toner image as the second color, a cyan toner image as the third color, and a black toner image as the fourth color, are successively transferred in the similar manner and overlapped onto the intermediate transfer member 10 so as to form an overlapped color toner image corresponding to the subjective color image.

A secondary transfer roller 34' and a secondary transfer counter roller 34" which is held by pivot so as to be parallel with the secondary transfer roller 34' are releasably arranged under the intermediate transfer member 10.

The primary transfer bias for the overlap transfer in the order of the first color toner image to the fourth color toner image has a reverse polarity to that of the toner and applied by a bias power source. The applying voltage is, for example, within the range of from +100 V to +2 kV.

The secondary transfer roller 34' and an intermediate transfer member cleaning means 16 may be released from the intermediate transfer member 10 in the course of the primary transfer process of the first to third colors from the photoreceptor drum 21 to the intermediate transfer member 10.

The secondary transfer of the color toner image overlapped on the belt-shaped intermediate transfer member 10 to the image receiving material P as the second image carrier is performed the following procedure: the secondary transfer roller 34' is touched to the intermediate transfer member 10 and the image receiving material P is supplied through the supplying roller r1 and the image receiving paper guide at a prescribed timing to the nip between the intermediate transfer member and the secondary transfer roller 34', then the secondary transfer bias is applied to the secondary transfer roller 43' from a bias power source. The overlapped color toner image is secondarily transferred to the image receiving material P as the secondary image carrier by the secondary transfer bias. The image receiving material on which the toner image is transferred is conducted into a fixing means 40 and fixed by heating.

The foregoing color electrophotographic image forming apparatus using the intermediate transfer member has advantages that the image can be transferred from the intermediate transfer member without any processing or controlling such as holding by clipper. subjecting to suction, or giving a curvature, on the image receiving material as the secondary image carrier, compared with a electrophotographic color image forming apparatus according to usual technology such as one described in Japanese Patent Publication Open to Public Inspection No. 63-301960, in which the image is transferred from a photoreceptor drum to an image receiving material. Accordingly, various kinds of second image carrier, such as an envelop, a post card, a label, a thin paper sheet (40 g/m$^2$) and a thick paper sheet (200 g/m$^2$), can be used not relating to the width, length and the thickness thereof in the foregoing image forming apparatus.

Figure 5:
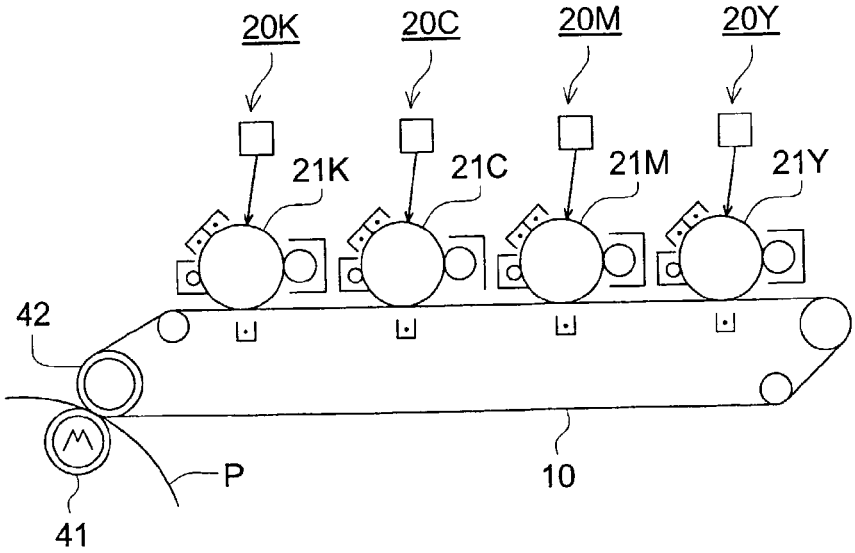
FIG. 5 shows a cross section of another image forming unit according to the invention.

FIG. 5 shows the cross section of another color image forming apparatus according to the invention.

This apparatus is called as tandem system. In the apparatus, a belt-shaped intermediate transfer member 10 is circulated and image forming units 20Y, 20M, 20C, and 20K are arranged at the upper side of the intermediate transfer member 10. Toner images are successively formed and transferred and overlapped on the belt-shaped intermediate transfer member 10 to form a color toner image. Such the process is the same as that shown in FIG. 1. The color toner image is transferred onto the image receiving material P (a plane paper sheet is used in this case) supplied at an adjusted timing between a heating roller 41 and a pressure roller 42 of a fixing means, the rollers also function as a secondary transferring means.

Figure 6:
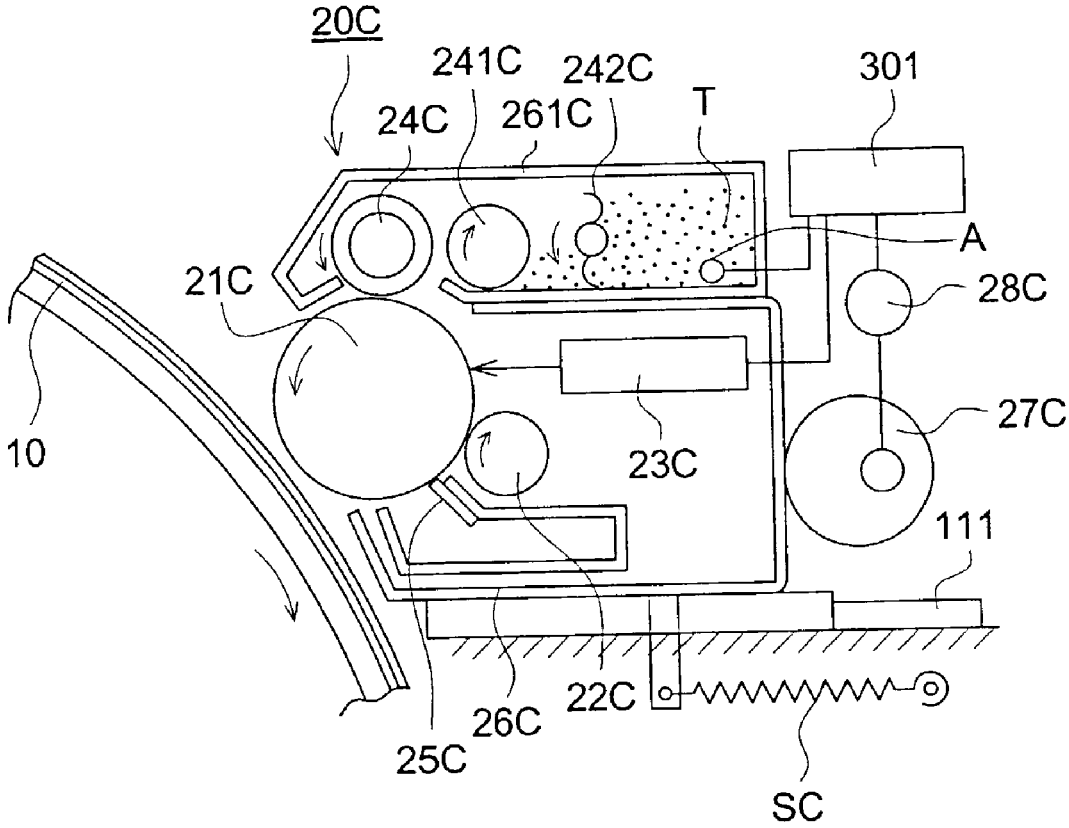
FIG. 6 shows a cross section of anther example of the image forming unit according to the invention.

FIG. 6 shows a cross section of an image forming apparatus different a little from that shown in FIG. 2, in which the developing means and the photoreceptor drum is releasable from the image forming unit to make changeable.

This example is described according to the example of the structure of the fore going image forming unit 20C.

A frame 26C constituting the foregoing image forming unit 20C is provided on a guiding member 111 and a movable member having a cam structure 27C is provided so as to touch to a part of the frame 26C. The image forming unit 20C is stopped at the prescribed image forming position together with the frame 26C by the movable member 27C against a spring SC. In the frame 26C, a charging means 22C and an exposing means 23C are arranged around the photoreceptor drum 21C as the image forming member. In a second frame 261C releasable from the frame 26C so as to be changeable, a developing means 24C, a developer supplying means 241C, and a developer stirring means 242C were provided so that the developing means 24C is faced to the circumference of the photoreceptor drum 21C.

A cyan toner C comprising a one-component developer T is charged in the second frame member 261C, and a remaining developer detecting means A for detecting the remaining amount of the developer T is provided in a developing means 24C.

A cyan toner image is formed on the photoreceptor drum 21C and the cyan toner image is transferred onto an intermediate transfer member 10 from the photoreceptor drum 21C. A cleaning means 25C is arranged so that the circumference of the photoreceptor drum 21C is cleaned by the cleaning means 25C after the transferring of the toner image.

Figure 7:
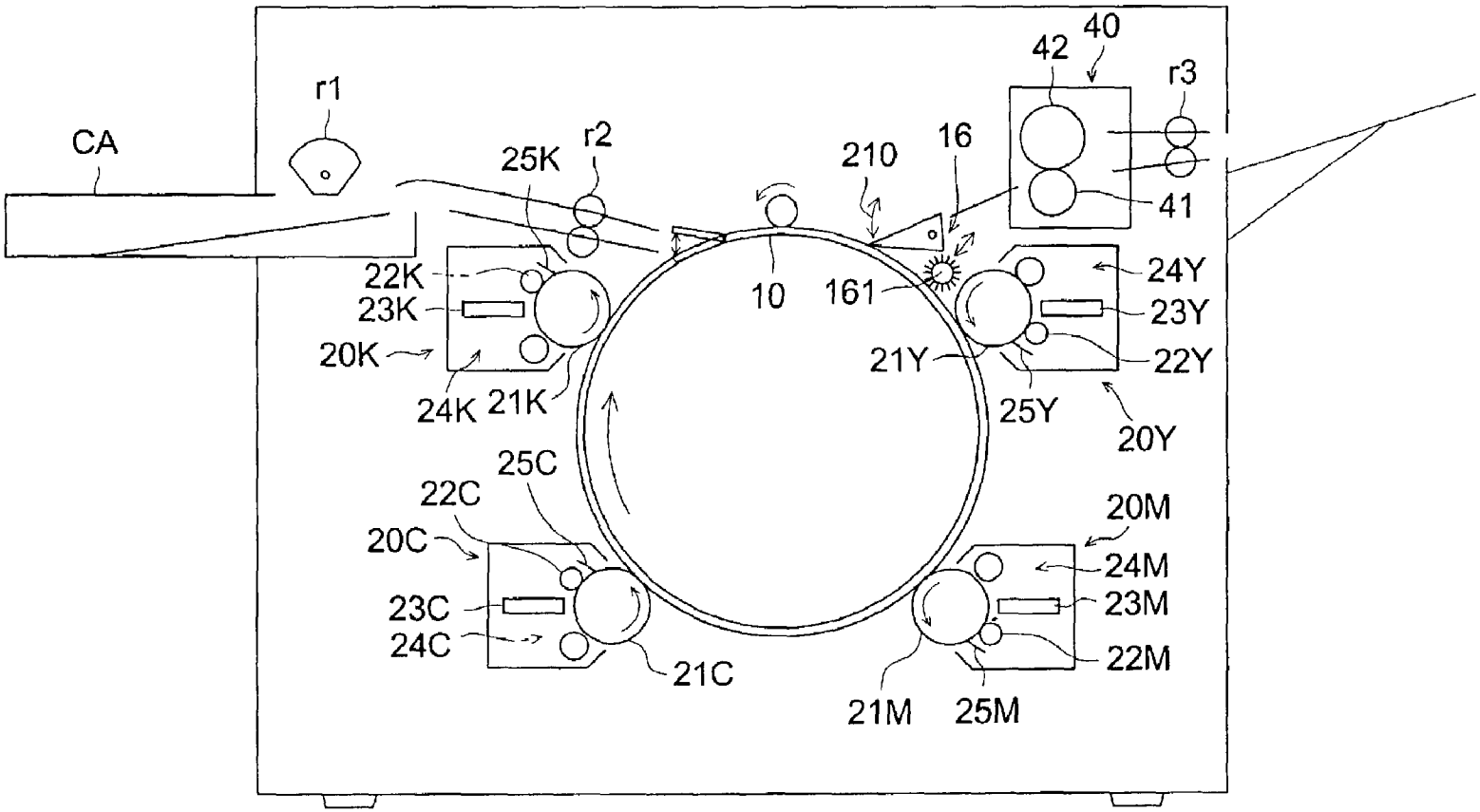
FIG. 7 shows a cross section of another image forming unit according to the invention.
Figure 8:
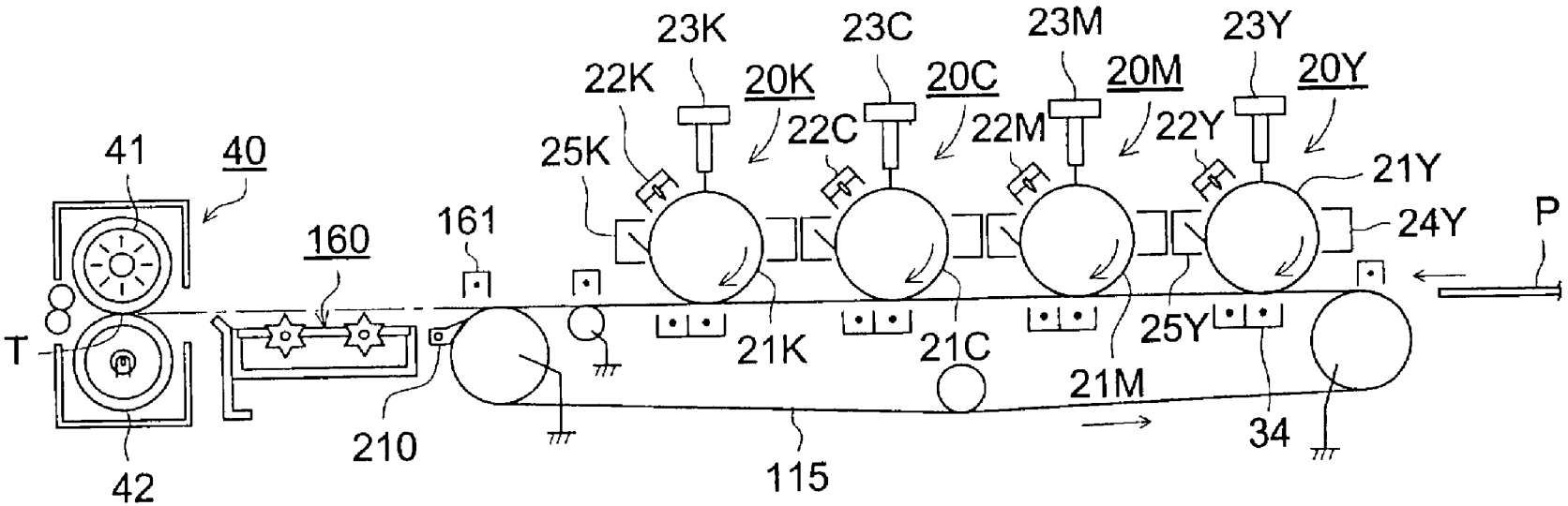
FIG. 8 shows a cross section of another image forming unit according to the invention.

FIG. 7 shows a color image forming apparatus in which a toner image is directly transferred onto an image receiving material on a drum without the use of any intermediate transfer member. FIG. 8 shows a color image forming apparatus in which the toner image is directly transferred onto a transfer belt. The image forming procedures in the apparatus of FIG. 7 and FIG. 8 are almost the same used in the pieces of apparatus shown in FIGS. 1 to 3 except that the image is directly transferred to the image receiving material in stead of the intermediate transfer member.

The apparatus shown in FIG. 8 is a example of a tandem color image forming apparatus in which four photoreceptor are arrange in a line and four colored toner image of yellow, magenta, cyan, and black are successively transferred.

The image forming apparatus shown in FIG. 8 has image forming units of 20Y, 20M, 20C, and 20K, each forming Y, M, C, and K toner images, each having photoreceptor drums 21Y, 21M, 21C, and 21K, scorotron charging devices (charging means) 24Y, 24M, 24C, and 24K, an exposing optical system (exposing means), developing devices (developing means) 22Y, 22M, 22C, and 22K, and cleaning devices (cleaning means) 25Y, 25M, 25C, and 25K, respectively, and the toner images each formed by the Y, M, C, and K image forming units are successively transferred onto the synchronously supplied image recording material, recording paper P) by transferring devices as transferring means to form a color toner image.

The recording material is transported on the transpiring belt 115 and released from the transporting belt by a discharging effect of a paper releasing AD discharging device 161 as the recording means and a releasing hook 210 provided at a transporting device 160 with a prescribed interval.

The recording paper is transported through the transporting device into a fixing device as the fixing means 40 comprising a heating roller 41 and a pressure roller 42. The recording paper P is inserted to a nip portion T between the heating roller 41 and the pressure roller 42 to fix the overlapped toner images on the recording paper P by applying heat and pressure. Thereafter, the recording paper P is output from the apparatus.

EXAMPLES

Embodiments of the invention are concretely described below. However, the constitution of the invention is not limited to these embodiments.

Photoreceptors were prepared as follows.

Preparation of Photoreceptor 1

The following interlayer coating liquid was prepared and coated onto a washed cylindrical aluminum substrate by an immersion coating method to form an interlayer having a dry thickness of 0.3 μm.

<Interlayer (UCL) Coating Liquid>

| | |
|---|---|
| Polyamide resin (Amiran CM-8000, Toray Co., Ltd.) | 60 g |
| Methanol | 1600 ml |

The following components were mixed and dispersed for 10 hours by a sand mill to prepare a charge generation layer coating liquid. The coating liquid was coated by the immersion coating method to form a charge generation layer having a thickness of 0.2 μm.

<Charge Generation Layer (CGL) Coating Liquid>

| | |
|---|---|
| Y-type titanylphthalocyanine (the maximum peak of X-ray diffraction by Cu-Kα characteristic X-ray is at a 2 θ angle of 27.3°) | 60 g |
| Silicone resin solution (15% xylene-butanol solution of KR5240, Shin'etsu Kagaku, co., Ltd.) | 700 g |
| 2-butanone | 2000 ml |

The following components were mixed and dissolved to prepare a charge transport layer coating liquid. The coating liquid was coated onto the foregoing charge generation layer by the immersion coating method to form a charge transport layer having a thickness of 20 μm.

<Charge Transport Layer (CTL) Coating Liquid>

| | |
|---|---|
| Charge transporting substance (4-methyoxy-4'-(4-methyl-α-phenylstyryl)triphenylamine) | 200 g |
| Bisphenol Z polycarbonate (IUPILON Z300, Mitsubishi Gas Kagaku Co., Ltd) | 300 g |
| 1,2-dichloroethane | 2000 ml |

The following components were mixed and dissolved to prepare a protective layer coating liquid.

<Surface Layer (OCL) Coating Liquid>

Molecular sieve A4 was added to 10 parts by weight of a polysiloxane resin composed of 80 mol-% of methylsiloxane unit and 20 mol-% of methyl-phenylsiloxane unit. The mixture was stood for 15 hours and subjected to a dewater treatment. The resin was dissolved in 10 parts by weight of toluene, and 5 parts by weight of methyltrimethoxysilane and 0.2 parts by weight of dibutyl-tin acetate were added to the solution to make a uniform solution. To the solution 6 parts by weight of dihydroxymethyltriphenylamine (Exemplified compound T-1) was added and mixed. The solution was coated so as to form a surface layer having a dry thickness of 2 μm. The coated layer was hardened by heating at 120° C. for 1 hour. Thus Photoreceptor 1 was prepared.

Preparation of Photoreceptor 2

Photoreceptor 2 was prepared in the same manner as in Photoreceptor 1 except that 0.3 parts by weight of a hindered amine (Exemplified compound 2-1) was added into the surface layer.

Preparation of Photoreceptor 3

Photoreceptor 3 was prepared in the same manner as in Photoreceptor 1 except that dihydroxymethyltriphenylamine in the surface layer is replaced by 4-[2-(triethoxysilyl)ethyl] triphenylamine.

Preparation of Photoreceptor 4

Photoreceptor 4 was prepared in the same manner as in Photoreceptor 2 except that the hindered amine in the surface layer was replaced by a hindered phenol (Exemplified compound 1-3).

Preparation of Photoreceptor 5

Photoreceptor 5 was prepared in the same manner as in Photoreceptor 1 except that the interlayer was replaced by the following interlayer.

<Interlayer (UCL) Coating Liquid>

| | |
|---|---|
| Chelated zirconium compound ZC-450 (Matsumoto Seiyaku Co., Ltd.) | 200 g |
| Silane coupling agent KBM-903 (Shin'etsu Kagaku Co., Ltd.) | 100 g |
| Methanol | 700 ml |
| Ethanol | 300 ml |

The above-mentioned coating liquid was coated and dried at 150° C. for 30 minutes to form an interlayer having a thickness of 1.0 μm.

Preparation of Photoreceptor 6

The following dispersion was prepared and coated onto a cylindrical aluminum substrate produced by a pull out production method to form an electroconductive layer having a dry thickness of 15 μm.

<Electroconductive Layer (PCL) Coating Liquid>

| | |
|---|---|
| Phenol resin | 160 g |
| Electroconductive titanium oxide | 200 g |
| Methyl cellosolve | 100 ml |

The following interlayer coating liquid was prepared. The coating liquid was coated onto the foregoing electroconductive layer by the immersion coating method to form an inter layer having a dry thickness of 1.0 μm.

<Interlayer (UCL) Coating Liquid>

| | |
|---|---|
| Polyamide resin (Amiran CM-8000, Toray Co., Ltd.) | 60 g |
| Methanol | 1600 ml |
| 1-butanol | 400 ml |

The following components were mixed and dispersed for 10 hours by a sand mill to prepare a charge generation layer coating liquid. The coating liquid was coated onto the fore going interlayer by the immersion method to form a charge generation layer having a dry thickness of 0.2 μm.

<Charge Generation Layer (CGL) Coating Liquid>

| | |
|---|---|
| Y-type titanylphthalocyanine | 60 g |
| Silicone resin solution (15% xylene-butanol solution of KR5240, Shin'etsu kagaku Co., Ltd.) | 700 g |
| 2-butanone | 2000 ml |

The following components were mixed and dissolved to prepare a charge transport layer. The coating liquid was coated onto the foregoing charge generation layer by the immersion coating method to form a charge transport layer having a thickness of 20 μm.

<Charge Transport Layer (CTL) Coating Liquid>

| | |
|---|---|
| Charge transporting substance (4-methoxy-4'-(4-methyl-α-phenylstyryl)triphenylamine) | 200 g |
| Bisphenol Z type polycarbonate (IUPILON Z300, Mitsubishi Gas Kagaku Co., Ltd.) | 300 g |
| 1,2-dichloroethane | 2000 ml |

The following components were mixed and dissolved to prepare a protective layer coating liquid.

<Surface Layer (OCL) Coating Liquid>

Molecular sieve A4 was added to 10 parts by weight of a polysiloxane resin composed of 80 mol-% of methylsiloxane unit and 20 mol-% of methyl-phenylsiloxane unit. The mixture was stood for 15 hours and subjected to a dewater treatment. The resin was dissolved in 10 parts by weight of toluene, and 5 parts by weight of methyltrimethoxysilane and 0.2 parts by weight of dibutyl-tin acetate were added to the solution to make a uniform solution. To the solution 6 parts by weight of dihydroxymethyltriphenylamine (Exemplified compound T-1) was added and mixed. The solution was coated so as to form a surface layer having a dry thickness of 2 μm. The coated layer was hardened by heating at 120° C. for 1 hour. Thus Photoreceptor 6 was prepared.

Preparation of Photoreceptor 7

Photoreceptor 7 was prepared in the same manner as in Photoreceptor 6 except that dihydroxymethyltriphenylamine in the surface layer was replaced by 4-[2-(triethoxysilyl) ethyl]triphenylamine and 0.3 parts by weight of a hindered amine (exemplified compound 2-1) was further added.

Preparation of Photoreceptor 8

Photoreceptor 8 was prepared in the same manner as in Photoreceptor 7 except that the hindered amine in the surface layer is replaced by a hindered phenol (Exemplified compound 1-3).

Preparation of Photoreceptor 9

Into 10 parts by weight of toluene, 10 parts by weight of a polymethylsiloxane resin containing 1% by weight of silanol group which was formed from 80 mol-% of methylsiloxane and 20 mol-% of dimethylsiloxane was dissolved, and molecular sieve 4A was added to thus obtained solution. The solution was dewatered after standing for 15 hours. Then 5 parts by weight of methyltrimethoxysilane and 0.2% by weight of dibutyl tin acetate were added to form a uniform solution. To 100 parts by weight of thus obtained composition, 200 parts by weight of toluene, 40 parts by weight of 4-[N,N-bis(3,4-dimethylphenyl)-amino][triethoxysilyl)ethyl]benzene, and 0.3 parts by weight of a hindered amine compound (Exemplified compound 2-7) were mixed to form a surface layer coating liquid. The coating liquid was coated onto a photoreceptor coated until the CTL in the same manner as in Photoreceptor 1 to form a surface layer having a thickness of 2 μm, and hardened by heating at 140° C. for 4 hours. Thus Photoreceptor 9 was prepared.

Preparation of Photoreceptor 10

Into 10 parts by weight of toluene, 10 parts by weight of a polymethylsiloxane resin containing 1% by weight of silanol group which was formed from 80 mol-% of methylsiloxane and 20 mol-% of dimethylsiloxane was dissolved, and molecular sieve 4A was added to thus obtained solution. The solution was dewatered after standing for 15 hours. Then 5 parts by weight of methyltrimethoxysilane and 0.2% by weight of dibutyl tin acetate were added to form a uniform solution. To 100 parts by weight of thus obtained composition, 200 parts by weight of toluene, 40 parts by weight of 4-[N,N-bis(3,4-dimethylphenyl)-amino][triethoxysilyl)ethyl]benzene, and 0.3 parts by weight of a hindered amine compound (Exemplified compound 2-7) were mixed to form a surface layer coating liquid. The coating liquid was coated onto a photoreceptor coated until the CTL in the same manner as in Photoreceptor 6 to form a surface layer having a thickness of 2 μm, and hardened by heating at 140° C. for 4 hours. Thus Photoreceptor 10 was prepared.

Preparation of Photoreceptor 11

Photoreceptor 11 was prepared in the same manner as in Photoreceptor 6 except that the electroconductive layer was replaced by the following composition.

<Electric Conductive Layer (PCL) Composition>

| | |
|---|---|
| Phenol resin | 160 g |
| Electroconductive barium sulfate | 200 g |
| Methyl cellosolve | 100 ml |
| Silicone resin particle (average diameter of 2 μm) | 3 g |

Preparation of Photoreceptor 12

Photoreceptor 12 was prepared in the same manner as in Photoreceptor 1 except that the aluminum cylindrical substrate was replaced by an anodized and pore-sealed aluminum cylindrical substrate.

Preparation of Photoreceptor 13

Photoreceptor 13 was prepared in the same manner as in Photoreceptor 1 except that that the aluminum cylindrical substrate was replaced by a anodized and pore-sealed aluminum cylindrical substrate, and the polysiloxane resin in the surface layer coating liquid was replaced by a polysiloxane resin containing 2% by weight of silanol group composed of 30 mol-% of methylsiloxane unit, 40 mol-% of ethylsiloxane unit, 20 mol-% of dimethylsiloxane unit, and 10 mol-% of diethylsiloxane unit.

Preparation of Photoreceptor 14

Photoreceptor 14 was prepared in the same manner as in Photoreceptor 1 except that the polysiloxane resin in the surface layer coating liquid was replaced by a polysiloxane resin containing 2% by weight of silanol group composed of 30 mol-% of methylsiloxane unit, 30 mol-% of phenylsiloxane unit, 20 mol-% of dimethylsiloxane unit, and 20 mol-% of diethylsiloxane unit.

Preparation of Photoreceptor 15

Photoreceptor 15 was prepared in the same manner as in Photoreceptor 1 except that dihydroxymethyltriphenylamine (Exemplified compound T-1) was replaced by a hydrazone compound, Exemplified compound H-1.

Preparation of Photoreceptor 16

Photoreceptor 16 was prepared in the same manner as in Photoreceptor 1 except that dihydroxymethyltriphenylamine (Exemplified compound T-1) was replaced by a stilbene compound, Exemplified compound S-1.

Preparation of Photoreceptor 17

Photoreceptor 17 was prepared in the same manner as in Photoreceptor 1 except that dihydroxymethyltriphenylamine (Exemplified compound T-1) was replaced by a benzidine compound, Exemplified compound Be-1.

Preparation of Photoreceptor 18

Photoreceptor 18 was prepared in the same manner as in Photoreceptor 1 except that dihydroxymethyltriphenylamine (Exemplified compound T-1) was replaced by a butadiene compound, Exemplified compound Bu-1.

Preparation of Photoreceptor 19

Photoreceptor 19 was prepared in the same manner as in Photoreceptor 1 except that dihydroxymethyltriphenylamine (Exemplified compound T-1) was replaced by Exemplified compound So-1.

Preparation of Photoreceptor 20

Photoreceptor 20 was prepared in the same manner as in Photoreceptor 1 except that dihydroxymethyltriphenylamine (Exemplified compound T-1) was replaced by Exemplified compound V-1.

Preparation of Photoreceptor 21

Photoreceptor 21 was prepared in the same manner as in Photoreceptor 1 except that dihydroxymethyltriphenylamine (Exemplified compound T-1) was replaced by Exemplified compound W-1.

Preparation of Photoreceptor 22

Photoreceptor 22 was prepared in the same manner as in Photoreceptor 1 except that the interlayer coating liquid was replaced by the coating liquid used in Photoreceptor 5, and 5 parts by weight of colloidal silica was added to the surface layer coating liquid.

Preparation of Photoreceptor 23

Photoreceptor 22 was prepared in the same manner as in Photoreceptor 1 except that 12 parts by weight of colloidal silica was added to the surface layer coating liquid.

Preparation of Photoreceptor 24

Sixty parts by weight of hardenable siloxane resin KP-854, Shin'etsu Kagaku Kogyo Co., Ltd., available on the market, was uniformly dissolved in 60 parts by weight of isopropanol. In the solution, 6 parts by weight of dihydroxyltriphenylamine (Exemplified compound T-1) was mixed. On a photoreceptor coated until CTL in the same manner as in Photoreceptor 1, thus obtained solution was coated and dried at 120° C. for 1 hour so as to form a layer having a dry thickness of 1 μm. Thus Photoreceptor 24 was prepared.

Preparation of Photoreceptor 25

Photoreceptor 25 was prepared in the same manner as in Photoreceptor 24 except that siloxane resin P-854 was replaced by X-2239, Shin'etsu Kagaku Kogyo Co., Ltd.

Preparation of Photoreceptor 26

Photoreceptor 26 was prepared in the same manner as in Photoreceptor 24 except that siloxane resin P-854 was replaced by X-40-2269, Shin'etsu Kagaku Kogyo Co., Ltd.

Preparation of Photoreceptor 27

Photoreceptor 27 was prepared in the same manner as in Photoreceptor 2 except that the hindered amine compound in the surface layer was replaced by a mixture of antioxidants Exemplified compounds 1-1 and 4-1) in a ratio of 1/1.

Preparation of Photoreceptor 28

Photoreceptor 28 was prepared in the same manner as in Photoreceptor 1 except that 0.25 parts by weight of silicone resin particles having an average diameter of 1 μm was added to the surface layer.

Preparation of Photoreceptor 29

Photoreceptor 29 was prepared in the same manner as in Photoreceptor 28 except that the silicone resin particles were replaced by 3 parts by weight of silica particles having an average diameter of 0.5 μm.

Preparation of Photoreceptor 30

A photoreceptor coated until the charge generation layer in the same manner as in Photoreceptor 1 was prepared.

A charge transport layer coating liquid was prepared by mixing and dissolving the following components.

<Charge Transport Layer CTL Coating Liquid>

| | |
|---|---|
| Charge transporting substance (Exemplified compound T-1) | 200 g |
| Methyltrimetoxysilane | 300 g |
| Hindered phenol compound (Exemplified compound 1-4) | 1 g |
| Colloidal silica (30% methanol solution) | 8 g |
| 1-butanol | 50 g |
| 1% acetic acid | 50 g |
| Aluminum tetraacetylacetate | 2 g |
| Fluorinated resin particles (average diameter of 1 μm) | 10 g |

The solution was coated onto the foregoing charge generation layer by the immersion method so as to form a charge transport layer having a thickness of 12 μm and hardened by heating at 110° C. for 2 hours. Thus Photoreceptor 30 was prepared Preparation of Photoreceptor 31

A photoreceptor coated until the charge transport layer in the same manner as in Photoreceptor 1 was prepared.

A surface layer coating liquid was prepared by mixing and dissolving the following components.

<Surface Layer (OCL) Coating Liquid>

| | |
|---|---|
| Charge transport substance (Exemplified compound T-1) | 200 g |
| Methyl trimethoxysilane | 300 g |
| Hindered phenol compound (exemplified compound 1-3) | 1 g |
| Colloidal silica 30% methanol solution) | 8 g |
| Ethanol/t-butanol (1/1 in weight ratio) | 50 g |
| 1% acetic acid | 50 g |
| Aluminum tetraacetylacetate | 2 g |
| Silicone oil (KF-54, Shin'etsu Kagaku Kogyo Co., Ltd.) | 1 g |

The liquid thus obtained was coated onto the foregoing charge transport layer and dried at 110° C. for 1 hour to form a surface layer having a dry thickness of 2 μm. Thus Photoreceptor 31 was prepared.

Preparation of Photoreceptor 32

Photoreceptor 32 was prepared in the same manner as in Photoreceptor 31 except that methyltrimethoxysilane was replaced by a mixture of methyltrimethoxysilane and dimethyl-dimethoxysilane in a ratio of 6/4, and silicone oil KF-54 was replaced by X-22-160AS.

Preparation of Photoreceptor 33

Photoreceptor 32 was prepared in the same manner as in Photoreceptor 30 except that the hindered phenol compound in the charge transport layer was replaced by an antioxidant (Exemplified compound 2-3) and the fluorinated resin particle s were replaced by silica particles having an average diameter of 2 μm.

Preparation of Photoreceptor 34

On the CTL of the Photoreceptor 1, a solution prepared by diluting Primer PC-7J, Shin'etsu Kagaku Kogyo Co., Ltd., available on the market by two times by toluene was coated and dried at 100 μC for 30 minutes to form an adhesive layer having a dry thickness of 0.3 μm. Beside, Molecular sieve 4A was added to 10 parts by weight of siloxane resin containing 1% by weight of silanol group composed of 80 mol-% of methylsiloxane and 20 mole-% of methyl-phenylsiloxane and the mixture was dewatered after standing for 15 hours. The resin was dissolved in 10 parts by weight of toluene. Then 5 parts by weight of methyltrimethoxysilane, 0.2 parts by weight of dibutyl tin acetate were added to the solution and uniformly dissolved. The solution thus obtained was mixed with 6 parts by weight of dihydroxymethyltriphenylamine (Exemplified compound T-1). The solution was coated onto the CTL and dried at 120° C. for 1 hour to form a surface layer having a dry thickness of 1 μm. Thus Photoreceptor 34 was prepared.

Preparation of Photoreceptor 35

Photoreceptor 35 was prepared in the same manner as in Photoreceptor 1 except that 6 parts by weight of dihyroxymethyltriphenylamine was omitted from the OCL.

Preparation of Photoreceptor 36

Photoreceptor 36 was prepared in the same manner as in Photoreceptor 1 except that the OCL was omitted.

Toners were prepared as follows.

Preparation of Toners 1-K, 1-Y, 1-M, and 1-C

One hundred parts of a styrene-acryl resin derived from styrene, butyl acrylate and methacrylate in a weight ratio of 75:20:5, 10 parts of carbon black, 4 parts of low molecular weight polypropylene having a number average molecular weight of 3,500 were molten and kneaded and pulverized by a mechanical crusher, and classified by a wind classifier so as to obtain colored particles having a volume average particle diameter of 4.2 μm. To the colored particles, 1.2% by weight of hydrophobic silica having a hydrophobicity of 75 and a number average primary particle diameter of 12 nm was added to prepare a toner. Thus obtained tone was referred to as Toner 1-K.

Toner 1-Y was prepared in the same manner as in Toner 1-K except that the 10 parts of the carbon black was replaced by 8 parts of C.I. Pigment Yellow 185.

Toner 1-M was prepared in the same manner as in Toner 1-K except that the 10 parts of the carbon black was replaced by 10 parts of C.I. Pigment Red 122.

Toner 1-C was prepared in the same manner as in Toner 1-K except that the 10 parts of the carbon black was replaced by 5 parts of C.I. Pigment Blue 15:3.

Preparation of Toners 2-K, 2-Y, 2-M, and 2-C

One hundred parts of a styrene-acryl resin derived form styrene, butyl acrylate and methacrylate in a weight ratio of 75:20:5, 10 parts of carbon black, 4 parts of low molecular weight polypropylene having a number average molecular weight of 3,500 were molten and kneaded and pulverized by a mechanical crusher, and classified by a wind classifier so as to obtain colored particles having a volume average particle diameter of 6.3 μm. To the colored particles, 1.2% by weight of hydrophobic silica having a hydrophobicity of 75 and a number average primary particle diameter of 12 nm was added to prepare a toner. Thus obtained tone was referred to as Toner 2-K.

Toner 2-Y was prepared in the same manner as in Toner 2-K except that the 10 parts of the carbon black was replaced by 8 parts of C.I. Pigment Yellow 185.

Toner 2-M was prepared in the same manner as in Toner 2-K except that the 10 parts of the carbon black was replaced by 10 parts of C.I. Pigment Red 122.

Toner 2-C was prepared in the same manner as in Toner 2-K except that the 10 parts of the carbon black was replaced by 5 parts of C.I. Pigment Blue 15:3.

Preparation of Toners 3-K, 3-Y, 2-M, and 3-C

One hundred parts of a styrene-acryl resin composed of styrene, butyl acrylate and methacrylate in a ratio weight of 70:20:10, 10 parts of carbon black, 4 parts of low molecular weight polypropylene having a number average molecular weight of 3,500 were molten and kneaded and pulverized by a mechanical crusher, and classified by a wind classifier so as to obtain colored particles having a volume average particle diameter of 5.0 μm. To the colored particles, 1.2% by weight of hydrophobic silica having a hydrophobicity of 75 and a number average primary particle diameter of 12 nm was added to prepare a toner. Thus obtained tone was referred to as Toner 3-K.

Toner 3-Y was prepared in the same manner as in Toner 3-K except that the 10 parts of the carbon black was replaced by 8 parts of C.I. Pigment Yellow 185.

Toner 3-M was prepared in the same manner as in Toner 3-K except that the 10 parts of the carbon black was replaced by 10 parts of C.I. Pigment Red 122.

Toner 3-C was prepared in the same manner as in Toner 3-K except that the 10 parts of the carbon black was replaced by 5 parts of C.I. Pigment Blue 15:3.

Preparation of Toners 4-K, 4-Y, 4-M, and 4-C

Ten liter of purified water and 0.90 Kg of sodium n-dodecylsulfate was stirred and dissolved. To the solution, 1.20 kg of Reagal 330R (carbon black manufactured by Cabot Co., Ltd.) was gradually added while the solution was stirred, and dispersed continuously for 20 hours by a sand grinder (medium type disperser). The particle diameter of thus obtained dispersion measured by an electrophoresis light scattering photometer ESL-800, manufacture by Otsuka Denshi Co., Ltd., was 122 nm in the weight average diameter. The solid content of the dispersion measured by a weighing method after dried by standing was 16.6% by weight. The dispersion was referred to as Colorant dispersion 1.

Sodium dodecylbenzenesulfonate of 0.055 kg was mixed with 4.0 l of ion-exchanged water and dissolved by stirring at a room temperature. This solution was referred to as Anionic surfactant solution A.

Nonylphenyl alkyl ether of 0.014 kg was mixed with 4.0 l of ion-exchanged water and dissolved by stirring at a room temperature. This solution was referred to as Nonionic surfactant solution A.

Potassium persulfate of 223.8 g was mixed with 12.0 l of ion-exchanged water and-dissolved by stirring at a room temperature. This solution was referred to as Initiator solution A.

Anion surfactant solution A, Nonion surfactant solution A, and 3.41 kg of polypropylene emulsion having a number average molecular weight (Mn) of 3,500 were put into a 100 l reaction vessel to which a thermal sensor, a cooling pipe and a nitrogen introducing device, and stirred. Then 44.0 l of ion-exchanged water was added.

Heating was started. Initiator solution A was all added when the temperature of the liquid was reached at 75° C. Then 12.1 kg of styrene, 2.88 kg of n-butyl acrylate, 1.04 kg of methacrylic acid and 548 g of t-dodecylmercaptane were added while the liquid temperature was controlled at 75°±1° C. Thereafter, the liquid temperature was raised to 80° C.±1° C. and heated and stirred for 6 hours. The liquid temperature was lowered by 40° C. or less and the liquid was filtered through a Pual filter. Thus obtained liquid was referred to as Latex A1.

The resin particle contained in Latex A1 had a glass transition temperature of 57° C., a softening point of 121° C., a weight average molecular weight of 12,700 and a weight average particle diameter of 120 nm.

Potassium persulfate of 200.7 g was mixed with 12.0 l of ion-exchanged water and-dissolved by stirring at a room temperature. This solution was referred to as Initiator solution B.

Nonion surfactant solution A was put into a 100 l vessel having a thermal sensor, a cooling pipe, a nitrogen introducing device, and a comb-shaped buffer plate and stirred. Then 44.0 l of ion-exchanged water was added.

The solution was heated and Initiator solution B was added to the liquid when the temperature was reached at 70° C. Then a mixture of 11.0 kg of styrene, 4.00 kg of n-butyl acrylate, 1.04 kg of methacrylic acid and 9.02 g of t-dodecylmercaptane was added.

The liquid was heated and stirred for 6 hours while the liquid temperature was controlled at 72° C.±1° C. Then the temperature was raised by 80° C.±2° C. and the liquid was heated and stirred for 12 hours at this temperature.

Thereafter, the liquid was cooled by 40° C. or less and the stirring was stopped. The liquid was filtered by a Paul filter. The filtrate was referred to as Latex B1.

The resin particle contained in Latex B1 had a glass transition temperature of 58° C., a softening point of 132° C., a weight average molecular weight of 245,000 and a weight average particle diameter of 110 nm.

As a salting agent, 5.36 kg of sodium chloride and 20.0 l of ion-exchanged water was put into a vessel and dissolved by stirring. This solution was referred to as Sodium chloride solution A.

Into a 100 l SUS reaction vessel having a thermal sensor, a cooling pipe, a nitrogen introducing device, a comb-shaped buffer plate, and a anchor wing stirrer, 20.0 kg of the above-prepared Latex A1, 5.2 g of Latex B, 0.4 kg of Colorant dispersion 1 and 20.0 kg of ion-exchanged water were put and stirred. Then the liquid was heated by 35° C. and Sodium chloride solution A was added to the liquid. After standing for 5 minutes, the liquid was heated by 85° C. during 5 minutes in a temperature raising rate of 10° C./minute. The liquid was heated and stirred for 6 hours at a liquid temperature of 85° C.±20° C. for salting off and melt associating the resin particles. Then the liquid was cooled by not more than 30° C. and stirring was stopped. The liquid was filtered by a sieve having a mesh of 45 μm. The filtrate was referred to as Associated liquid 1. Then non-spherical particles in a wet cake state was separated from Associated liquid 1 by the use of a centrifuge, and the wet cake of the particles was washed by ion-exchanged water.

The washed wet cake of the colored particles was dried by wind heated at 40° C. to obtained colored particles. The volume average diameter of the colored particles was 4.3 μm A hydrophobic silica having a hydrophobicity of 65 and a number average primary particle diameter of 12 nm was added in an amount of 1.0% by weight to the colored particles. Thus Toner 4-K was prepared.

Toner 4-Y was prepared in the same manner as in Toner 4-K except that the 10 parts of the carbon black was replaced by 8 parts of C.I. Pigment Yellow 185.

Toner 4-M was prepared in the same manner as in Toner 4-K except that the 10 parts of the carbon black was replaced by 10parts of C.I. Pigment Red 122.

Toner 4-C was prepared in the same manner as in Toner 4-K except that the 10 parts of the carbon black was replaced by 5 parts of C.I. Pigment Blue 15:3.

Preparation of Toners 5-K, 5-Y, 5-M, and 5-C

Colored particles were prepared in the same manner as in Toner K-4 except that the melt associating condition was changed for varying the particle size. A hydrophobic silica having a hydrophobicity of 65 and a number average primary diameter of 12 nm was added to thus obtained colored particles. Thus Toner 5-K was prepared.

Toner 5-Y was prepared in the same manner as in Toner 5-K except that the 10 parts of the carbon black was replaced by 8 parts of C.I. Pigment Yellow 185.

Toner 5-M was prepared in the same manner as in Toner 5-K except that the 10 parts of the carbon black was replaced by 10 parts of C.I. Pigment Red 122.

Toner 5-C was prepared in the same manner as in Toner 5-K except that the 10 parts of the carbon black was replaced by 5 parts of C.I. Pigment Blue 15:3.

Preparation of Toners 6-K, 6-Y, 6-M, and 6-C

One hundred parts of a polyester resin having an acid value of 45, 10 parts of carbon black, 4 parts of low molecular weight polypropylene having a number average molecular weight of 3,500 were molten and kneaded and pulverized by a mechanical crusher, and classified by a wind classifier so as to obtain colored particles having a volume average particle diameter of 6.9 μm. To the colored particles, 1.2% by weight of hydrophobic silica having a hydrophobicity of 75 and a number average primary particle diameter of 12 nm was added to prepare a toner. Thus obtained tone was referred to as Toner 6-K.

Toner 6-Y was prepared in the same manner as in Toner 6-K except that the 10 parts of the carbon black was replaced by 8 parts of C.I. Pigment Yellow 185.

Toner 6-M was prepared in the same manner as in Toner 6-K except that the 10 parts of the carbon black was replaced by 10 parts of C.I. Pigment Red 122.

Toner 6-C was prepared in the same manner as in Toner 6-K except that the 10 parts of the carbon black was replaced by 5 parts of C.I. Pigment Blue 15:3.

The saturated moisture content of the foregoing toners were measured under a condition of a temperature of 30° C. and a relative humidity of 80%. The measured results are shown In Table 1.

TABLE 1

| Toner No. | Exemplified toner preparation method No. | Volume average particle diameter (μm) | Saturated moisture content (% by weight) | Sum of $m_1$ and $m_2$ (%) |
|---|---|---|---|---|
| 1-K | 1 | 4.2 | 0.3 | 72 |
| 1-Y | 1 | 5.9 | 0.5 | 73 |
| 1-M | 1 | 6.3 | 0.3 | 72 |
| 1-C | 1 | 5.1 | 0.3 | 75 |
| 2-K | 2 | 6.3 | 1.2 | 85 |
| 2-Y | 2 | 6.9 | 1.5 | 88 |
| 2-M | 2 | 8.3 | 1.3 | 87 |
| 2-C | 2 | 8.8 | 1.2 | 81 |
| 3-K | 3 | 5.0 | 1.8 | 87 |
| 3-Y | 3 | 6.4 | 1.8 | 71 |
| 3-M | 3 | 5.7 | 1.7 | 75 |
| 3-C | 3 | 8.6 | 1.8 | 76 |
| 4-K | 4 | 4.3 | 1.2 | 73 |
| 4-Y | 4 | 4.9 | 1.5 | 88 |
| 4-M | 4 | 5.3 | 1.3 | 89 |
| 4-C | 4 | 4.8 | 1.2 | 91 |
| 5-K | 5 | 5.0 | 1.8 | 86 |

TABLE 1-continued

| Toner No. | Exemplified toner preparation method No. | Volume average particle diameter (μm) | Saturated moisture content (% by weight) | Sum of $m_1$ and $m_2$ (%) |
|---|---|---|---|---|
| 5-Y | 5 | 6.4 | 1.8 | 89 |
| 5-M | 5 | 5.7 | 1.7 | 91 |
| 5-C | 5 | 8.6 | 1.8 | 90 |
| 6-K | 6 | 10.4 | 2.2 | 68 |
| 6-Y | 6 | 9.9 | 2.5 | 65 |
| 6-M | 6 | 10.3 | 2.2 | 63 |
| 6-C | 6 | 10.1 | 2.3 | 67 |

Measuring method of the volume average particle diameter of the toner particle: The value was measured by Coulter Multisizer.

Measuring method of the relative frequency degree of number distribution of the toner particles: The particle size data of each of the toner were transferred to a computer through an I/O unit, and the sum M of relative frequency degree $m_1$ and $m_2$ was determined by the computer.

Measuring method of the saturated moisture content under the condition of 30° C. and 80% RH: The toner to be measured was stood for 3 days under the condition of 30° C. and 80% RH, and subjected to measurement by Karl-Fischer method. For example, the measurement can be performed by the use of Hiranuma Type Automatic Micro Moisture Content Measuring Apparatus AQS-724. In the measuring condition in the invention, the temperature and time for evaporation were 110° C. and 25 seconds, respectively.

Preparation of Developer

The 24 kinds of toner, Toners 1-K through 6-C, were each mixed with a ferrite carrier covered with a silicone resin having a volume average particle diameter of 45 μm, so as to prepare developers each having a toner content of 6%, and subjected to the evaluation. Thus obtained 24 kinds of developer were each referred to as Developers 1-K through 6-C corresponding each of the toner.

The volume average particle diameter of the carrier can be measured by a laser diffraction particle size distribution measuring apparatus having a wet dispersing device such as Helos manufactured by Sympatec Co., Ltd.

<Evaluation>

Inventive and comparative image forming units of Y, M, C and K were prepared by combinations of the toners and the photoreceptors shown in Tables 2 to 5, in which the same four photoreceptors were used as to each of the formula. Each of the image forming unit are installed in an intermediate transfer type digital copying machine shown in FIG. 1. An A4 size original image including a white background, of black, red, green, blue solid images, and a character image was copied by the copying machine using 50,000 sheets of neutral paper under an ordinary condition (20° C., 60% RH) or a high temperature and high humidity condition (30° C., 80% RH) with respect to the each combination of the toner and the photoreceptor. Images printed out on the initial, 2,000th and 50,000th sheets were each evaluated. Results of the evaluation are listed in Tables 2 to 5.

Processing Condition of the Image Forming Unit

Charging: Roller charging device

Imagewise exposing: Semiconductor laser

Developing: Two-component contacting reversal development in which the photoreceptor and the developer was contacted.

Cleaning: A cleaning blade having a hardness of 70°, a bound elasticity of 34% a thickness of 2 mm, and a free length of 7 mm was touched to the photoreceptor in a reverse direction with a line pressure of 20 g/cm by a weight.

(1) Image Quality Evaluation

The density of the image and the fog were measure on the 50,000th printed sheet by Densitometer RD-918, manufactured by Macbeth Co., Ltd. The image density was measured as the absolute density and the fog is measured as the relative density when the density of paper was set at zero. The occurrence of the blur of image was visually evaluated.

a. Image Density

A: Not less than 1.3/Suitable

B: From 0.001 to less than 0.005/No problematic level for the practical use

C: Less than 1.0/Problematic for the practical use b. Fog

A: Less than 0.001/Suitable

B: From 0.001 to less than 0.005/No problematic level for the practical use

C: Not less than 0.005/Problematic for the practical use c. Blur of Image Evaluated on the Character Image A: Blur of image was occurred on 5 sheets per 50,000 sheets of the copy/Suitable.

B: Blur of image was occurred on from 6 to 20 sheets per 50,000 sheets of the copy/No problematic level for the practical use.

C: Blur of image was occurred on more than 20 sheets per 50,000 sheets of the copy/Problematic for the practical use.

d. Fine Line Reproducibility

Width of line image corresponding to a 2 dot-line was measured by a printed character evaluation system RT2000, manufactured by Yaman Co., Ltd.

A: The width of the line of the first print L1 and that of the 2000th print L200 were either not more than 200 μm and the variation of the line width (L1–L2000) was not more than 10 μm/Suitable B: Other than the above-mentioned/Problematic for the practical use e. Color Difference The colors of the solid image of the secondary color (red, blue, and green) by the toners of Y, M and C formed on the first and 50,000th copy were measured by Macbeth Color-Eye 7000 and the color difference was calculated according to the CMC (2:1) color difference equation.

A: Color difference of not more than 5/Suitable

B: Color difference of more than 5/Problematic for the practical use f. Evaluation of Black Spot The diameter and the number of the black spot were measured by an image analyzing apparatus Omnicon 300, manufactured by Shimazu Seisakysho Co., Ltd., and evaluated by the number of black spot having a diameter of not less than 0.1 mm per 100 $cm^2$ of the copy print. Moreover, a large defect such as a scratch was visually evaluated. The judging norms were as follows.

Number of the black spot through 50,000 sheets of copy

A: Not more than 1 per A4 sheet/Suitable

B: 2 to 3 per A4 sheet/No problematic level for the practical use

C: 4 or more per A4 sheet/Problematic for the practical use g. Difference of Abraded Thickness Between the Four Photoreceptors-used in the Same Time The abraded thickness of each of the photoreceptors was measured after 50,000 copies.

($\Delta d_1$, $\Delta d_2$, $\Delta d_3$, $\Delta d_4$)

Layer thickness of photoreceptor after 50,000 copies−Layer thickness of photoreceptor at the initial copy=Abraded thickness $\Delta d$ (μm)

Difference of the abraded thickness of the four photoreceptors $\Delta d_M = \Delta d_{max} - \Delta d_{min}$ The $\Delta d_{max}$ and $\Delta d_{min}$ were each the maximum and the minimum abraded thickness $\Delta d$ among the $\Delta d_1$, $\Delta d_2$, $\Delta d_3$ and $\Delta d_4$, respectively.

Method for Measuring the Layer Thickness of the Photoreceptor

The layer thickness of the photoreceptor is an average of the thicknesses measured at 10 points at random on the uniform layer portion of the photoreceptor. An eddy current layer thickness measuring apparatus Eddy 560C, manufactured by Helmut Fischer GMBT Co., Ltd., was used for measuring the layer thickness.

h. Discrepancy of the Image Registration

The discrepancy width of the magenta and cyan images was measured with respect to a line image corresponding to a two-dot line formed by overlapping magenta and cyan.

A: Less than 70 μm/Suitable

B: From 70 to 100 μm/No problem on the practical use

C: From 100 to 150 μm/Not acceptable for the practical use

D: More than 150 μm/Not suitable

TABLE 2

| | Number of toners used in combination | Photo-receptor No. | Fine line reproduci-bility | Difference of abraded thickness between four photo-receptors $\Delta_M$ (μm) |
|---|---|---|---|---|
| Example 1 | 1-K/1-Y/1-M/1-C | 1 | A | <0.1 |
| Example 2 | 1-K/1-Y/1-M/1-C | 2 | A | <0.1 |
| Example 3 | 1-K/1-Y/1-M/1-C | 3 | A | <0.1 |
| Example 4 | 2-K/2-Y/2-M/2-C | 4 | A | <0.1 |
| Example 5 | 2-K/2-Y/2-M/2-C | 5 | A | <0.1 |
| Example 6 | 2-K/2-Y/2-M/2-C | 6 | A | <0.1 |
| Example 7 | 2-K/2-Y/2-M/2-C | 7 | A | <0.1 |
| Example 8 | 2-K/2-Y/2-M/2-C | 8 | A | <0.1 |
| Example 9 | 2-K/2-Y/2-M/2-C | 9 | A | <0.1 |
| Example 10 | 2-K/2-Y/2-M/2-C | 10 | A | <0.1 |
| Example 11 | 3-K/3-Y/3-M/3-C | 11 | A | <0.1 |
| Example 12 | 3-K/3-Y/3-M/3-C | 12 | A | <0.1 |
| Example 13 | 3-K/3-Y/3-M/3-C | 13 | A | <0.1 |
| Example 14 | 3-K/3-Y/3-M/3-C | 14 | A | <0.1 |
| Example 15 | 4-K/4-Y/4-M/4-C | 15 | A | <0.1 |
| Example 16 | 4-K/4-Y/4-M/4-C | 16 | A | <0.1 |
| Example 17 | 4-K/4-Y/4-M/4-C | 17 | A | <0.1 |
| Example 18 | 4-K/4-Y/4-M/4-C | 18 | A | <0.1 |
| Example 19 | 4-K/4-Y/4-M/4-C | 19 | A | <0.1 |
| Example 20 | 4-K/4-Y/4-M/4-C | 20 | A | <0.1 |

| | Color differ-ence | Blur of image | Image defect | Image density | Fog | Registra-tion discrepancy of image |
|---|---|---|---|---|---|---|
| Example 1 | A | A | A | A | A | A |
| Example 2 | A | A | A | A | A | A |
| Example 3 | A | A | A | A | A | A |
| Example 4 | A | A | A | A | A | A |
| Example 5 | A | A | A | A | A | A |
| Example 6 | A | A | A | A | A | A |

TABLE 2-continued

| | | | | | | |
|---|---|---|---|---|---|---|
| Example 7 | A | A | A | A | A | A |
| Example 8 | A | A | A | A | A | A |
| Example 9 | A | A | A | A | A | A |
| Example 10 | A | A | A | A | A | A |
| Example 11 | A | A | A | A | A | A |
| Example 12 | A | A | A | A | A | A |
| Example 13 | A | A | A | A | A | A |
| Example 14 | A | A | A | A | A | A |
| Example 15 | A | A | A | A | A | A |
| Example 16 | A | A | A | A | A | A |
| Example 17 | A | A | A | A | A | A |
| Example 18 | A | A | A | A | A | A |
| Example 19 | A | A | A | A | A | A |
| Example 20 | A | A | A | A | A | A |

TABLE 3

| | Number of toners used in combination | Photo-receptor No. | Fine line reproduci-bility | Difference of abraded thickness between four photo-receptors $\Delta_M$ (μm) |
|---|---|---|---|---|
| Example 21 | 4-K/4-Y/4-M/4-C | 21 | A | <0.1 |
| Example 22 | 5-K/5-Y/5-M/5-C | 22 | A | <0.08 |
| Example 23 | 5-K/5-Y/5-M/5-C | 23 | A | <0.08 |
| Example 24 | 5-K/5-Y/5-M/5-C | 24 | A | <0.08 |
| Example 25 | 5-K/5-Y/5-M/5-C | 25 | A | <0.1 |
| Example 26 | 5-K/5-Y/5-M/5-C | 26 | A | <0.1 |
| Example 27 | 5-K/5-Y/5-M/5-C | 27 | A | <0.1 |
| Example 28 | 5-K/5-Y/5-M/5-C | 28 | A | <0.1 |
| Example 29 | 5-K/5-Y/5-M/5-C | 29 | A | <0.1 |
| Example 30 | 5-K/5-Y/5-M/5-C | 30 | A | <0.08 |
| Example 31 | 5-K/5-Y/5-M/5-C | 31 | A | <0.08 |
| Example 32 | 5-K/5-Y/5-M/5-C | 32 | A | <0.08 |
| Example 33 | 5-K/5-Y/5-M/5-C | 33 | A | <0.08 |
| Example 34 | 5-K/5-Y/5-M/5-C | 34 | A | <0.1 |
| Comparative example 1 | 6-K/6-Y/6-M/6-C | 1 | C | <0.1 |
| Comparative example 2 | 6-K/6-Y/6-M/6-C | 2 | C | <0.1 |
| Comparative example 3 | 6-K/6-Y/6-M/6-C | 15 | C | <0.1 |
| Comparative example 4 | 6-K/6-Y/6-M/6-C | 28 | C | <0.1 |
| Comparative example 5 | 2-K/2-Y/2-M/2-C | 35 | C | ~3 |
| Comparative example 6 | 2-K/2-Y/2-M/2-C | 36 | C | ~5 |

| | Color differ-ence | Blur of image | Image defect | Image density | Fog | Registra-tion discrepancy of image |
|---|---|---|---|---|---|---|
| Example 21 | A | A | A | A | A | A |
| Example 22 | A | A | A | A | A | A |
| Example 23 | A | A | A | A | A | A |
| Example 24 | A | A | A | A | A | A |
| Example 25 | A | A | A | A | A | A |
| Example 26 | A | A | A | A | A | A |
| Example 27 | A | A | A | A | A | A |
| Example 28 | A | A | A | A | A | A |
| Example 29 | A | A | A | A | A | A |

TABLE 3-continued

| | | | | | | |
|---|---|---|---|---|---|---|
| Example 30 | A | A | A | A | A | A |
| Example 31 | A | A | A | A | A | A |
| Example 32 | A | A | A | A | A | A |
| Example 33 | A | A | A | A | A | A |
| Example 34 | A | A | A | A | A | A |
| Comparative example 1 | A | C | C | B | C | C |
| Comparative example 2 | A | C | C | B | C | C |
| Comparative example 3 | A | C | C | B | C | C |
| Comparative example 4 | A | C | C | B | C | C |
| Comparative example 5 | C | C | C | C | C | C |
| Comparative example 6 | C | C | C | C | C | C |

TABLE 4

| | Number of toners used in combination | Photo-receptor No. | Fine line reproduci-bility | Difference of abraded thickness between four photo-receptors $\Delta_M$ (μm) |
|---|---|---|---|---|
| Example 1 | 1-K/1-Y/1-M/1-C | 1 | A | <0.1 |
| Example 2 | 1-K/1-Y/1-M/1-C | 2 | A | <0.1 |
| Example 3 | 1-K/1-Y/1-M/1-C | 3 | A | <0.1 |
| Example 4 | 2-K/2-Y/2-M/2-C | 4 | A | <0.1 |
| Example 5 | 2-K/2-Y/2-M/2-C | 5 | A | <0.1 |
| Example 6 | 2-K/2-Y/2-M/2-C | 6 | A | <0.1 |
| Example 7 | 2-K/2-Y/2-M/2-C | 7 | A | <0.1 |
| Example 8 | 2-K/2-Y/2-M/2-C | 8 | A | <0.1 |
| Example 9 | 2-K/2-Y/2-M/2-C | 9 | A | <0.1 |
| Example 10 | 2-K/2-Y/2-M/2-C | 10 | A | <0.1 |
| Example 11 | 3-K/3-Y/3-M/3-C | 11 | A | <0.1 |
| Example 12 | 3-K/3-Y/3-M/3-C | 12 | A | <0.1 |
| Example 13 | 3-K/3-Y/3-M/3-C | 13 | A | <0.1 |
| Example 14 | 3-K/3-Y/3-M/3-C | 14 | A | <0.1 |
| Example 15 | 4-K/4-Y/4-M/4-C | 15 | A | <0.1 |
| Example 16 | 4-K/4-Y/4-M/4-C | 16 | A | <0.1 |
| Example 17 | 4-K/4-Y/4-M/4-C | 17 | A | <0.1 |
| Example 18 | 4-K/4-Y/4-M/4-C | 18 | A | <0.1 |
| Example 19 | 4-K/4-Y/4-M/4-C | 19 | A | <0.1 |
| Example 20 | 4-K/4-Y/4-M/4-C | 20 | A | <0.1 |

| | Color differ-ence | Blur of image | Image defect | Image density | Fog | Registra-tion discrepancy of image |
|---|---|---|---|---|---|---|
| Example 1 | A | A | A | A | A | A |
| Example 2 | A | A | A | A | A | A |
| Example 3 | A | A | A | A | A | A |
| Example 4 | A | A | A | A | A | A |
| Example 5 | A | A | A | A | A | A |
| Example 6 | A | A | A | A | A | A |
| Example 7 | A | A | A | A | A | A |
| Example 8 | A | A | A | A | A | A |
| Example 9 | A | A | A | A | A | A |
| Example 10 | A | A | A | A | A | A |
| Example 11 | A | A | A | A | A | A |
| Example 12 | A | A | A | A | A | A |
| Example 13 | A | A | A | A | A | A |
| Example 14 | A | A | A | A | A | A |
| Example 15 | A | A | A | A | A | A |
| Example 16 | A | A | A | A | A | A |
| Example 17 | A | A | A | A | A | A |
| Example 18 | A | A | A | A | A | A |
| Example 19 | A | A | A | A | A | A |
| Example 20 | A | A | A | A | A | A |

TABLE 5

| | Number of toners used in combination | Photo-receptor No. | Fine line reproduci-bility | Difference of abraded thickness between four photo-receptors $\Delta_M$ (μm) |
|---|---|---|---|---|
| Example 21 | 4-K/4-Y/4-M/4-C | 21 | A | <0.1 |
| Example 22 | 5-K/5-Y/5-M/5-C | 22 | A | <0.05 |
| Example 23 | 5-K/5-Y/5-M/5-C | 23 | A | <0.05 |
| Example 24 | 5-K/5-Y/5-M/5-C | 24 | A | <0.05 |
| Example 25 | 5-K/5-Y/5-M/5-C | 25 | A | <0.1 |
| Example 26 | 5-K/5-Y/5-M/5-C | 26 | A | <0.1 |
| Example 27 | 5-K/5-Y/5-M/5-C | 27 | A | <0.1 |
| Example 28 | 5-K/5-Y/5-M/5-C | 28 | A | <0.1 |
| Example 29 | 5-K/5-Y/5-M/5-C | 29 | A | <0.1 |
| Example 30 | 5-K/5-Y/5-M/5-C | 30 | A | <0.05 |
| Example 31 | 5-K/5-Y/5-M/5-C | 31 | A | <0.05 |
| Example 32 | 5-K/5-Y/5-M/5-C | 32 | A | <0.05 |
| Example 33 | 5-K/5-Y/5-M/5-C | 33 | A | <0.05 |
| Example 34 | 5-K/5-Y/5-M/5-C | 34 | A | <0.1 |
| Comparative example 1 | 6-K/6-Y/6-M/6-C | 1 | C | <0.1 |
| Comparative example 2 | 6-K/6-Y/6-M/6-C | 2 | C | <0.1 |
| Comparative example 3 | 6-K/6-Y/6-M/6-C | 15 | C | <0.1 |
| Comparative example 4 | 6-K/6-Y/6-M/6-C | 28 | C | <0.1 |
| Comparative example 5 | 2-K/2-Y/2-M/2-C | 35 | C | ~3 |
| Comparative example 6 | 2-K/2-Y/2-M/2-C | 36 | C | ~5 |

| | Color differ-ence | Blur of image | Image defect | Image density | Fog | Registra-tion discrepancy of image |
|---|---|---|---|---|---|---|
| Example 21 | A | A | A | A | A | A |
| Example 22 | A | A | A | A | A | A |
| Example 23 | A | A | A | A | A | A |
| Example 24 | A | A | A | A | A | A |
| Example 25 | A | A | A | A | A | A |
| Example 26 | A | A | A | A | A | A |
| Example 27 | A | A | A | A | A | A |
| Example 28 | A | A | A | A | A | A |
| Example 29 | A | A | A | A | A | A |
| Example 30 | A | A | A | A | A | A |
| Example 31 | A | A | A | A | A | A |
| Example 32 | A | A | A | A | A | A |
| Example 33 | A | A | A | A | A | A |
| Example 34 | A | A | A | A | A | A |
| Comparative example 1 | A | C | C | C | C | C |
| Comparative example 2 | A | C | C | C | C | C |
| Comparative example 3 | A | C | C | C | C | C |
| Comparative example 4 | A | C | C | C | C | C |
| Comparative example 5 | C | C | C | C | C | C |
| Comparative example 6 | C | C | C | C | C | C |

Si-1
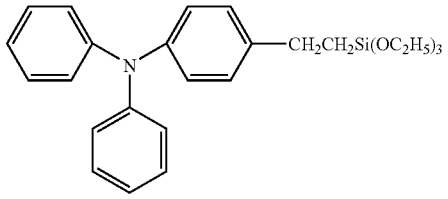
Si-2
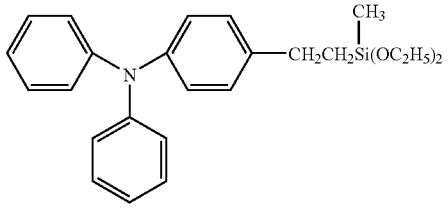
Si-3
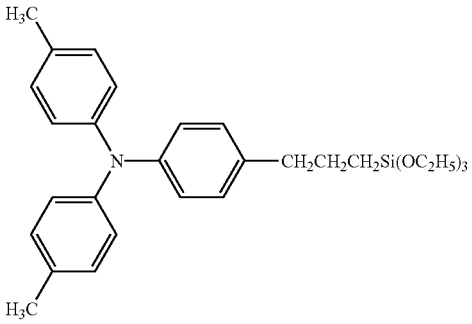
Si-4
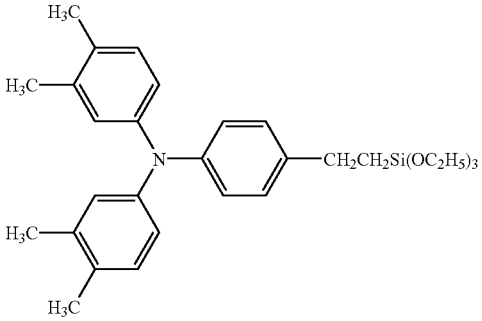
Si-5
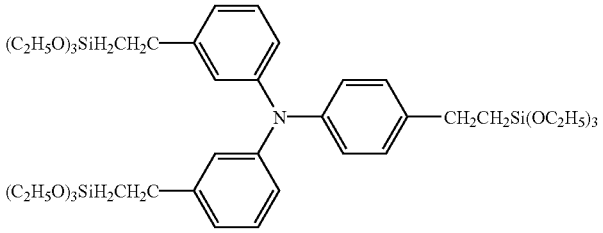
Si-6
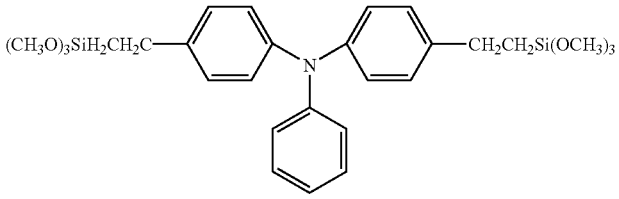

-continued
Si-7
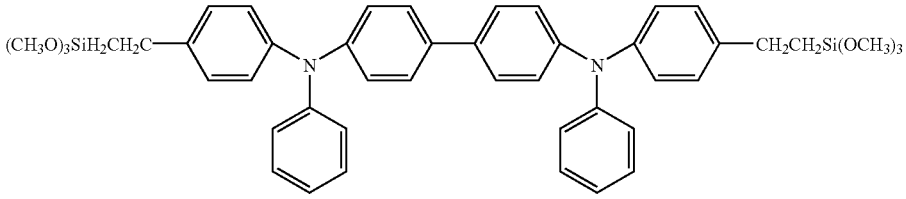
Si-8
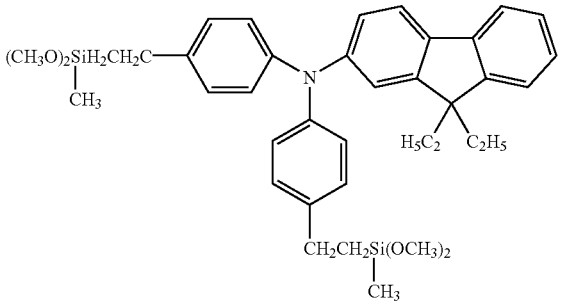
Si-9
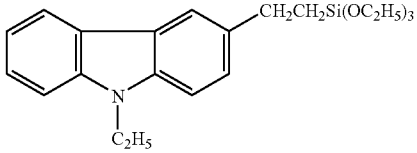
Si-10
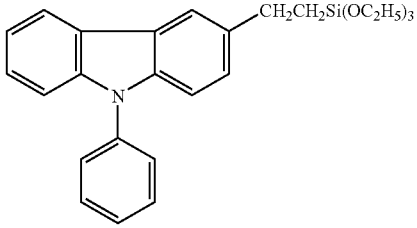
Si-11
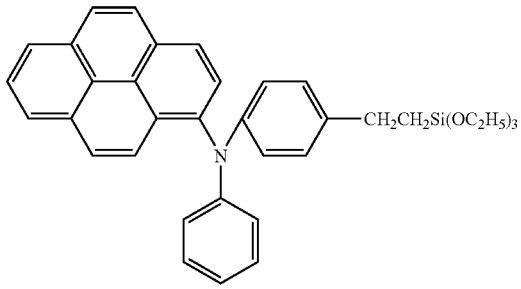
Si-12
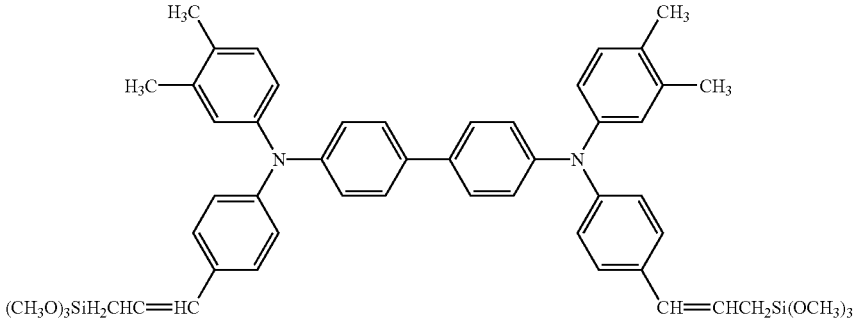

-continued

Si-13

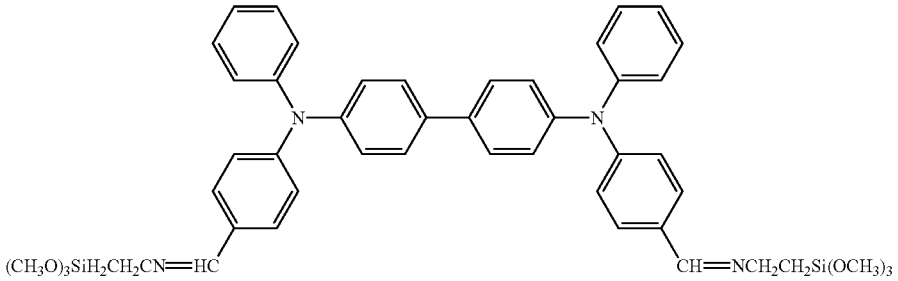

Si-14

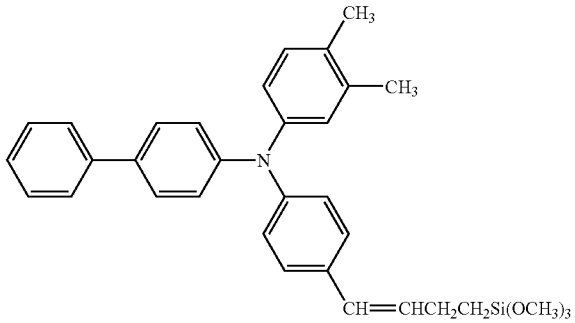

Si-15

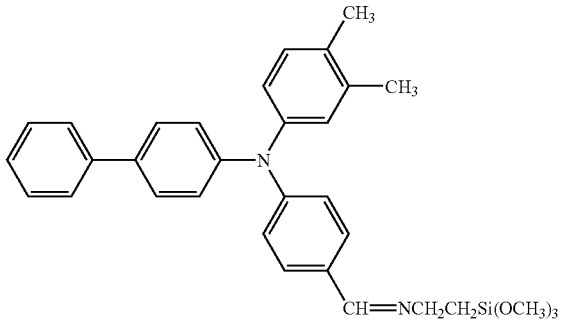

As is shown in Tables 2 to 5, in Examples 1 through 34 according to the invention, no fogging was occurred on the initial and 50,000th copies, the reflective density of the black solid image was 1.2 or more was obtained, and the image excellent in the color balance without registration discrepancy of image was obtained under the either conditions. Moreover, the difference the abraded thickness between each of the photoreceptors after 50,000 sheets copying was very small as not more than 0.1 μm. The black spot and the image defect such as blur were also not occurred and the image resolution was excellent.

On the other hand, good images cannot be obtained in Comparative examples 5 an 6 in which no siloxane resin according to the invention was contained, and Comparative examples 1 through 4 in which the moisture content of the each toner was exceeds the limitation of the invention.

The similar results were obtained by employing image forming unit shown in FIG. 1, which is installed in a tandem type digital copying machine.

Charging device was replaced by scorotron discharger.

The electrophotographic image without any image defect such as the registration discrepancy of image can be obtained by the intermediate transfer image forming apparatus according to the invention even under a condition with a high temperature and a high humidity. Furthermore, a clear color image without any degradation of image quality such as the occurrence of black spot and the blur of image can be obtained according to the invention.

A good image without degradation of color balance and occurrence of a black spot and image blurring caused by toner filming can be obtained by the tandem color image forming apparatus using the combination of the photoreceptor containing the siloxane resin and the toner having a small moisture content according to the invention when the repeating the apparatus is repeatedly used.

The invention claimed is:

1. An image forming method employing an image forming apparatus having a photoreceptor comprising a photosensitive layer and a surface layer on a support, a charging means, an exposing means for irradiating light, a developing means, a transferring means, and a cleaning means, the image forming method comprising charging a surface of the photoreceptor by the charging means, exposing the photoreceptor to form a static latent image on the surface of the photoreceptor by the exposing means, developing the static latent image on the surface of the photoreceptor with a toner and forming a colored toner image corresponding to the static latent image by the developing means, transferring the toner image to an intermediate transfer member, transferring the toner image from the intermediate transfer member to an image receiving material by the transferring means, and removing the toner remained on the photoreceptor surface by the cleaning means, wherein said toner used in the developing means has a saturated moisture content within the range of from 0.1 to 2.0% by weight at a temperature of 30° C. and a relative humidity of 80%, at least 70 percent of the toner exhibits sum (M) of (M1) and (M2), (M1) being the relative frequency of toner particles included in the highest frequency class and (M2) being the relative frequency of toner particles included in the second highest frequency class, in a number based histogram in which natural logarithm ln D is taken as the abscissa and said abscissa is divided into a plurality of classes at an interval of 0.23, D being diameter of toner particles in μm, and the surface layer contains a siloxane resin having an electric charge transfer ability and a crosslinked structure.

2. The image forming method of claim 1, wherein the developing means comprises a plurality of developing units containing color toners having different color from each other.

3. The image forming method of claim 1, wherein the apparatus comprises a plurality of developing means, and the plurality of developing means are provided around the electrophotographic photoreceptor, each of the plurality of developing means is successively operated whereby each of monocolor toner images is formed on the photoreceptor which is transferred to the intermediate transfer member successively to form a color image overlapped on the intermediate transfer member, and the color image overlapped on the intermediate transfer member is transferred all at once onto the image receiving material.

4. The image forming method of claim 1, wherein the image forming apparatus further comprises a plurality of image forming units, wherein each of the image forming units comprises the developing means and the photoreceptor, each of the developing means contains a toner having different color from each other, and the plurality of image forming units is provided around the intermediate transfer member so that the each of images formed by the plurality of the plurality of image forming units is transferred to the intermediate transfer member to form a color image overlapped on the intermediate transfer member.

5. The image forming method of claim 1, wherein the siloxane resin contains structure represented by the following Formula 1, and has a crosslinked structure, Formula 1

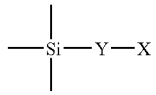

wherein the formula X is a structural unit having charge transportability, Y is a bonding group of two or more valents, and Si is silicon atom.

6. The image forming method of claim 5, wherein Y is an atom or group of two or more valents and X is a charge transferable structural unit containing a carbon atom which bonds to Y through the carbon atom.

7. The image forming method of claim 6, wherein Y is an oxygen atom, sulfur atom or —NR group wherein R is hydrogen atom or a monovalent organic group.

8. The image forming method of claim 1, wherein the siloxane resin has a crosslinked structure obtained by reacting an organic silicon compound containing hydroxy group or hydrolyzable group with a compound having charge-transferable structure unit containing hydroxy group.

9. The image forming method of claim 1, wherein the siloxane resin is obtained by crosslinking an organic silicon compound and a compound having charge-transferable structure unit containing two or more reactive functional group.

10. The image forming method of claim 9, wherein the toner has a volume average diameter of 4 to 9 μm, and toner particles having diameter of 3.0 μm is not more than 30% by number.

11. The image forming method of claim 1, wherein the surface layer of the photoreceptor contains an anti-oxidant.

12. The image forming method of claim 11, wherein the anti-oxidant includes hindered phenol or hindered amine compound.

13. The image forming method of claim 1, wherein the surface layer of the photoreceptor contains organic or inorganic fine particles.

14. The image forming method of claim 1, wherein the surface layer of the photoreceptor contains colloidal silica.

15. An image forming method employing an image forming apparatus having a plurality of image forming units, each of the image forming units including a photoreceptor which comprises a photosensitive layer and a surface layer; a charging device to charge the photoreceptor; an exposing device to expose the photoreceptor to form a latent image; a developing device to develop the latent image with a toner to form a toner image; a transferring device to transfer the toner image; and a cleaning device to remove the remained toner on the photoreceptor, wherein each of the image forming units comprise a toner having a color different from each other, the method comprising:

a) charging the photoreceptor;

b) exposing the photoreceptor to form a static latent image on the photoreceptor;

c) developing the static latent image on the photoreceptor with the toner to form the toner image;

d) transferring the toner image to an image receiving material by a transferring means; and e) removing the toner remained on the photoreceptor;

wherein the toner used in the developing device has a saturated moisture content within the range of from 0.1 to 2.0% by weight at a temperature of 30° C. and a relative humidity of 80%, and the surface layer contains a siloxane resin having an electric charge transfer ability and a crosslinked structure.

16. The method of claim 15, wherein the apparatus further comprises an intermediate transferring member which holds the toner image and transfers the toner image on an image recording material, the transferring step transfers the toner image on the image transferring member.

17. The image forming method of claim 15, wherein the siloxane resin contains structure represented by the following Formula 1, and has a crosslinked structure, Formula 1

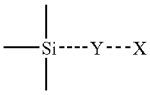

wherein the formula X is a structural unit having charge transportability, Y is a bonding group of two or more valents, and Si is silicon atom.

18. The image forming method of claim 17, wherein Y is an atom or group of two or more valents and X is a charge transferable structural unit containing a carbon atom which bonds to Y through the carbon atom.

19. The image forming method of claim 18, wherein Y is an oxygen atom, sulfur atom or —NR group wherein R is hydrogen atom or a monovalent organic group.

20. The image forming method of claim 15, wherein the siloxane resin has a crosslinked structure obtained by reacting an organic silicon compound containing hydroxy group or hydrolyzable group with a compound having charge-transferable structure unit containing hydroxy group.

21. The image forming method of claim 15, wherein at least 70 percent of the toner exhibits sum (M) of (M1) and (M2), (M1) being the relative frequency of toner particles included in the highest frequency class and (M2) being the relative frequency of toner particles included in the second highest frequency class, in a number based histogram in which natural logarithm ln D is taken as the abscissa and said abscissa is divided into a plurality of classes at an interval of 0.23, D being diameter of toner particles in μm.

* * * * *